US007278275B2

(12) United States Patent
Voglewede et al.

(10) Patent No.: US 7,278,275 B2
(45) Date of Patent: Oct. 9, 2007

(54) MECHANISM FOR DISPENSING SHAVED ICE FROM A REFRIGERATION APPLIANCE

(75) Inventors: Ronald L. Voglewede, St. Joseph, MI (US); Jerry M. Visin, Benton Harbor, MI (US); Marcus R. Fischer, St. Joseph, MI (US); Daryl Lee Harmon, Evansville, IN (US); Gary W. Wilson, Sellersburg, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 136 days.

(21) Appl. No.: 11/080,724

(22) Filed: Mar. 15, 2005

(65) Prior Publication Data

US 2006/0207270 A1 Sep. 21, 2006

(51) Int. Cl.
*F25C 5/02* (2006.01)

(52) U.S. Cl. ..... 62/320; 241/DIG. 17

(58) Field of Classification Search ..... 62/320, 62/344; 241/101.01, DIG. 17
See application file for complete search history.

(56) References Cited

U.S. PATENT DOCUMENTS

| | | | | | |
|---|---|---|---|---|---|
| 3,824,805 | A | * | 7/1974 | Prada | 62/320 |
| 4,123,918 | A | * | 11/1978 | Kohl et al. | 62/320 |
| 4,176,527 | A | | 12/1979 | Linstromberg et al. | 62/320 |
| 4,718,610 | A | | 1/1988 | Gallaher | 241/37.5 |
| 4,745,773 | A | | 5/1988 | Ando | 62/230 |
| 4,786,002 | A | * | 11/1988 | Mitsubayashi et al. | 241/101.8 |
| 5,050,777 | A | | 9/1991 | Buchser | 222/146.6 |
| 5,323,691 | A | * | 6/1994 | Reese et al. | 99/275 |
| 5,375,432 | A | | 12/1994 | Cur | 62/320 |
| 5,513,810 | A | | 5/1996 | Lin | 241/95 |
| 5,680,771 | A | * | 10/1997 | Yoo et al. | 62/320 |
| 6,050,097 | A | | 4/2000 | Nelson et al. | 62/137 |
| 6,082,130 | A | | 7/2000 | Pastryk et al. | 62/344 |
| 6,772,675 | B2 | * | 8/2004 | Ervin | 99/275 |

FOREIGN PATENT DOCUMENTS

| | | | |
|---|---|---|---|
| JP | 359031654 A | * | 2/1984 |
| JP | 02004185215 A | * | 7/2004 |

* cited by examiner

*Primary Examiner*—William E. Tapolcai
(74) *Attorney, Agent, or Firm*—Michael D. Lafrenz; Kirk W. Goodwin

(57) ABSTRACT

A mechanism for dispensing ice in each of three selected forms, namely, cubed, crushed and shaved. This mechanism includes a reservoir arranged to hold a supply of ice cubes, a dispensing zone, a delivery mechanism arranged for dispensing ice cubes from said reservoir to said dispensing zone, an ice crushing mechanism located in said dispensing zone arranged to selectively crush ice, an ice shaving mechanism located in said dispensing zone arranged to selectively shave ice, and a control mechanism arranged to selectively activate said ice crushing mechanism and said ice shaving mechanism upon receipt of an appropriate input from a user.

38 Claims, 24 Drawing Sheets

MECHANISM FOR DISPENSING SHAVED ICE FROM A REFRIGERATION APPLIANCE

BACKGROUND OF THE INVENTION

Appliances are known for dispensing ice in multiple forms, such as ice cubes and crushed ice. Some appliances that dispense ice in that fashion are domestic refrigeration appliances such as combined refrigerator/freezer appliances where the ice cubes and crushed ice are delivered through the door of the appliance, such as shown and described in U.S. Pat. Nos. 4,176,527, 5,050,777, 6,050,097 and 6,082,130. Other devices are known for dispensing shaved ice, however, these are typically stand alone appliances that dispense only shaved ice, such as those disclosed in U.S. Pat. Nos. 4,718,610, 4,745,773 and 5,513,810.

Many shaved ice dispensers require time to set up, clean and stow, and also require adult supervision, preventing them from being used independently by children.

U.S. Pat. No. 5,680,771 discloses a mechanism for producing only shaved ice in a refrigeration appliance in which a dedicated ice container is used for the freezing of a discrete quantity of water, and which is manipulated and driven relative to a fixed blade for producing a quantity of shaved ice. Operation of the mechanism requires the manual manipulation of two separate pivotable or rotatable handles, which can only be accessed through the opening of a door of the freezer compartment of the refrigeration appliance.

It would be an improvement in the art if there were provided a mechanism for dispensing ice in multiple forms, including each of ice cubes, crushed ice and shaved ice. It would also be an improvement in the art if a refrigeration appliance were provided that dispensed each of ice cubes, crushed ice and shaved ice. It would further be an improvement in the art if a refrigeration appliance were provided that dispensed shaved ice through the door of the appliance.

SUMMARY OF THE INVENTION

The present invention provides a mechanism for dispensing shaved ice from a refrigeration appliance. In an embodiment of the invention, the shaved ice is dispensed through a door of the refrigeration appliance. In an embodiment of the invention, the refrigeration appliance includes a refrigerated compartment, an ice making mechanism in the refrigerated compartment, an ice delivery system arranged to deliver ice from the ice making mechanism, an ice shaving mechanism located in the refrigeration appliance arranged to selectively shave ice received from the ice delivery system, and an ice dispensing system arranged to dispense ice, wherein ice may be dispensed in a shaved condition or a non-shaved condition.

In an embodiment, the refrigeration appliance may include a reservoir arranged to hold a supply of ice cubes, a dispensing zone, a delivery mechanism arranged for dispensing ice cubes from the reservoir to the dispensing zone, an ice shaving mechanism located in the dispensing zone arranged to selectively shave ice, and a control mechanism arranged to selectively activate the ice shaving mechanism upon receipt of an appropriate input from a user.

In an embodiment, a mechanism is provided for dispensing ice in multiple forms, including each of ice cubes, crushed ice and shaved ice.

In an embodiment, the mechanism may include a reservoir arranged to hold a supply of ice cubes, a dispensing zone, a delivery mechanism arranged for dispensing ice cubes from the reservoir to the dispensing zone, an ice crushing mechanism located in the dispensing zone arranged to selectively crush ice, an ice shaving mechanism located in the dispensing zone arranged to selectively shave ice, and a control mechanism arranged to selectively activate the ice crushing mechanism and the ice shaving mechanism upon receipt of an appropriate input from a user.

In an embodiment, the mechanism is provided within a refrigeration appliance and the ice forms, including shaved ice, are dispensed through a door of the appliance. Such an arrangement confines the moving parts of the mechanism within the appliance or the door of the appliance such that the mechanism is safe to use, and such that children can use the mechanism without adult supervision. Also, the mechanism does not require separate set up or clean up operations, but is always ready for use.

In an embodiment, the ice crushing mechanism comprises an arm rotatably driven by a motor.

In an embodiment, the ice shaving mechanism comprises a pusher rotatably driven by a motor for pushing ice and a fixed blade against which the ice is pushed by the rotating pusher.

In an embodiment, the ice shaving mechanism comprises a pusher and a blade, at least one of which is rotated relative to the other by a motor.

In an embodiment, the dispensing outlet comprises a vertical passage.

In an embodiment, the dispensing outlet comprises a non-vertical passage.

In an embodiment, the dispensing outlet comprises a movable door to collect a batch of shaved ice prior to dispensing.

In an embodiment, the dispensing outlet comprises an auger to collect a batch of shaved ice prior to dispensing.

In an embodiment, the dispensing outlet comprises a paddle to collect a batch of shaved ice prior to dispensing.

In an embodiment, the dispensing zone comprises a single well in which each of ice cubes, crushed ice and shaved ice is dispensed to a user.

In an embodiment, a movable door is provided to allow ice to bypass said ice shaving mechanism.

In an embodiment, the single well includes a pusher and a plate having different openings therein for selective passage of ice cubes, crushed ice and shaved ice.

In an embodiment, a cover is positioned over the plate, the cover having an ice passage therethrough, and being rotatable relative to the plate.

In an embodiment, the dispensing zone comprises two wells, wherein through a first well, two of the three ice forms are dispensed to a user and through a second well, a third of the three ice forms is dispensed to a user.

In an embodiment, the ice crushing mechanism comprises an arm rotatably driven by a motor and the ice shaving mechanism comprises a pusher rotatably driven by a motor for pushing ice and a fixed blade against which the ice is pushed by the rotating pusher, wherein the motor driving the arm of the ice crushing mechanism and the motor driving the pusher of the ice shaving mechanism comprise the same motor.

DETAILED DESCRIPTION OF THE PREFERRED EMBODIMENT

The present invention provides a mechanism for delivering ice in each of three selected forms, namely, cubed, crushed and shaved. This mechanism can be arranged within an appliance such as a domestic refrigerator having a refrigerated compartment, or other types of appliances, including freezers and ice makers.

The present invention further provides for dispensing shaved ice from a refrigeration appliance. The shaved ice may be dispensed through a door of the appliance. The refrigeration appliance may have a refrigerated compartment, held below room temperature, and perhaps, but not necessarily, below freezing temperature, an ice making mechanism in the refrigerated compartment, an ice delivery system arranged to deliver ice from the ice making mechanism, an ice shaving mechanism located in the refrigeration appliance arranged to selectively shave ice received from the ice delivery system, and an ice dispensing system arranged to dispense ice, wherein ice may be dispensed in a shaved condition or a non-shaved condition, as described in greater detail below.

In order to describe a preferred embodiment of the invention, the environment of a side-by-side refrigerator is illustrated and discussed, however, it should be understood that the present invention is not limited to use in such an environment.

Generally, as used herein, ice cubes are bodies of ice having a three dimensional shape, wherein a length in any of the dimensions is not less than about 2 cm. Shaved ice comprises bodies of ice having a three dimensional shape, in which at least one of the dimensions has a length of no greater than about 5 mm. Crushed ice comprises bodies of ice having a three dimensional shape, in which at least one of the dimensions has a length greater than about 5 mm, but less than about 2 cm and no dimension has a length greater than about 5 cm.

Figure 1:
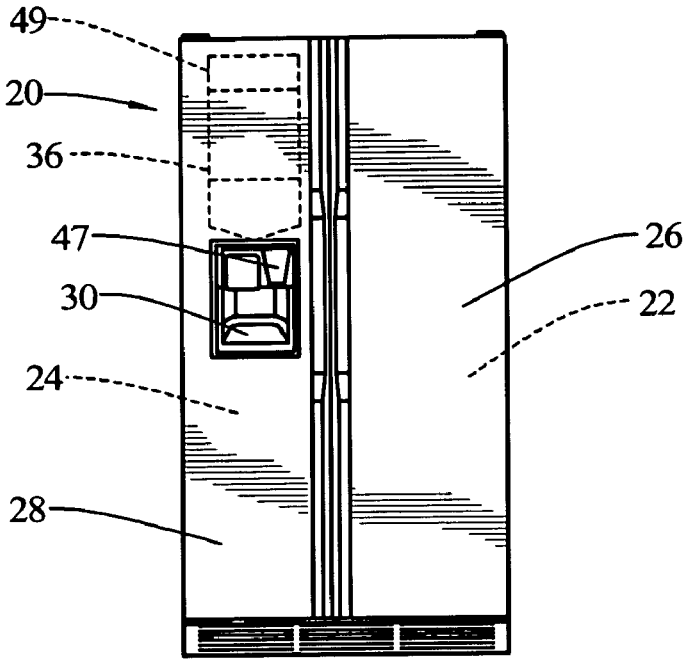
FIG. 1 is a front view of a refrigerator apparatus having a mechanism for delivering ice embodying the present invention.

In FIG. 1 there is illustrated a side-by-side domestic refrigerator 20 having a refrigeration compartment 22 and a freezer compartment 24, each accessed by a respective door 26, 28. Located in the door 28 of the freezer compartment 24 is illustrated a dispenser 30 which allows for the dispensing of ice and perhaps water through the freezer door. It should be noted that the dispenser 30 could also be located in the refrigerator door 26, and that the arrangement of the refrigeration compartment 22 relative to the freezer compartment 24 could be different, such as by having the freezer compartment located above or below the refrigeration compartment. See, for example, U.S. Pat. No. 5,375,432, incorporated herein by reference.

Figure 2:
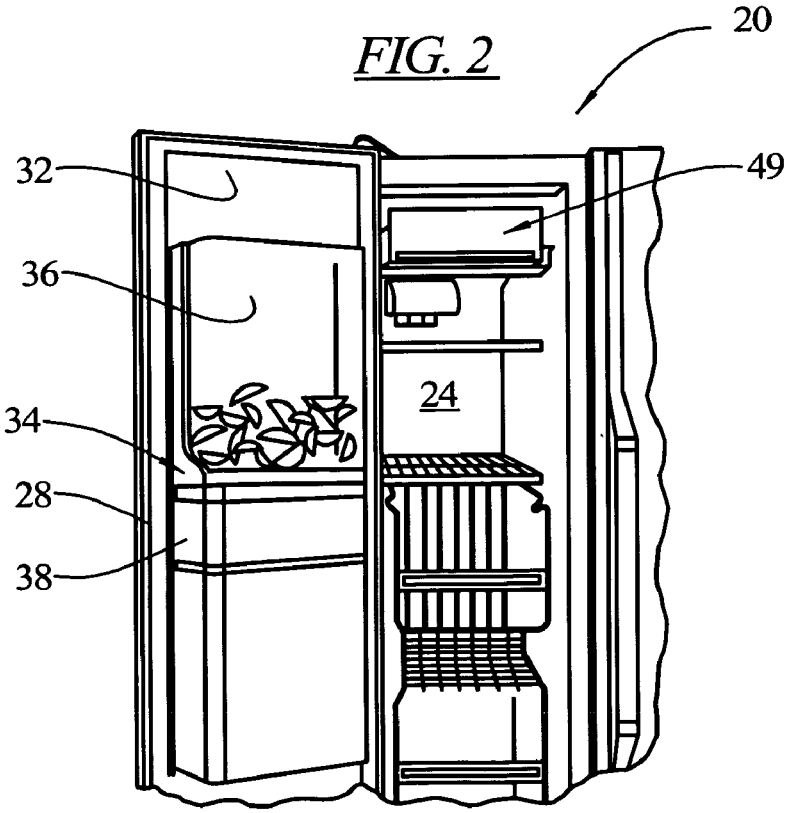
FIG. 2 is a fragmentary perspective view illustrating the mechanism within the freezer compartment of the refrigerator apparatus with the freezer door open.
Figure 3:
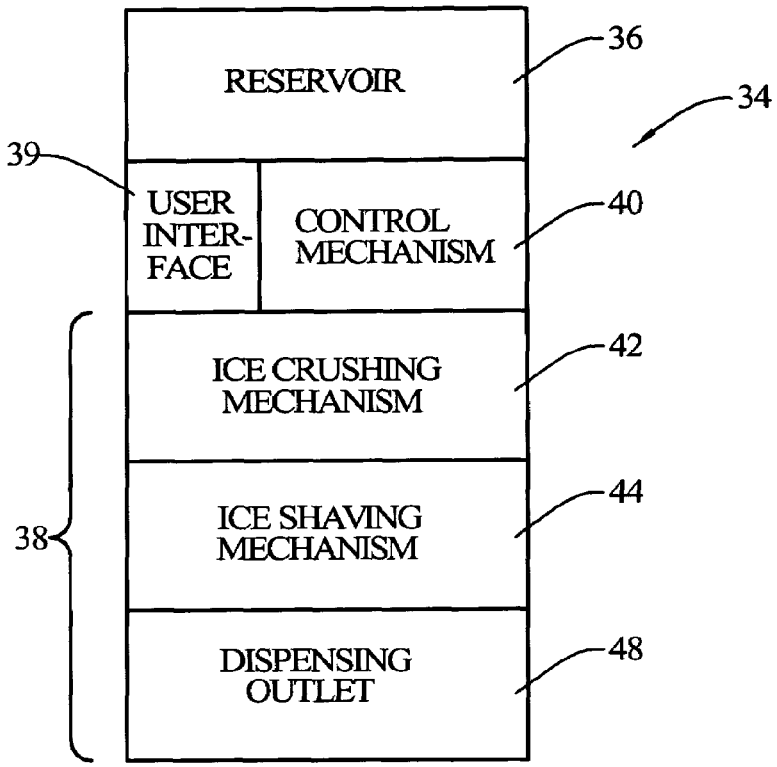
FIG. 3 is a schematic illustration of the mechanism components in a single well configuration.
Figure 4:
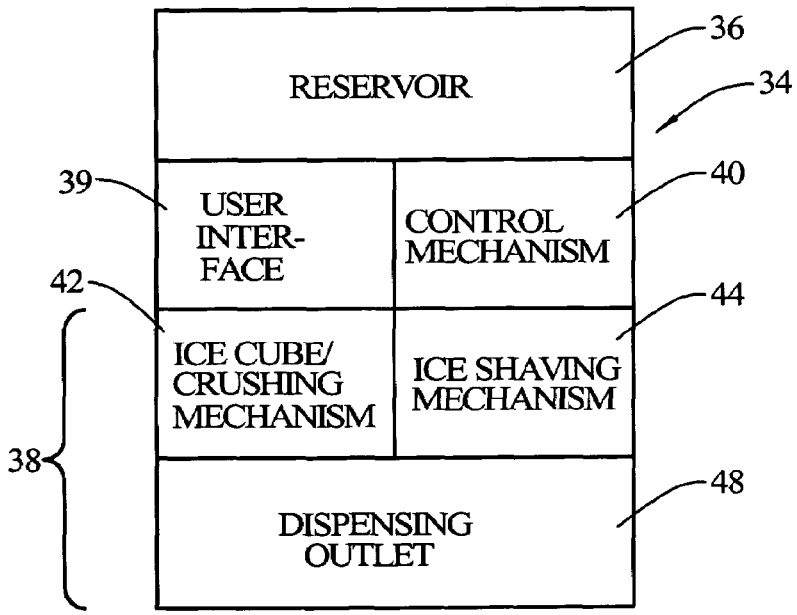
FIG. 4 is a schematic illustration of the mechanism components in a two well configuration.

Located on a back side 32 of the freezer door 28, as shown in FIG. 2 and schematically in FIGS. 3 and 4, is a mechanism 34 for delivering ice in each of three selected forms, namely, cubed, crushed and shaved. The mechanism 34 includes a supply mechanism for supplying ice cubes, which may include an ice making mechanism and/or a reservoir 36 arranged to hold a supply of ice cubes. The mechanism 34 for delivering ice further includes a dispensing zone 38, a user interface 39 and a control mechanism 40 arranged to effect dispensing ice cubes from the reservoir to the dispensing zone, potentially an ice crushing mechanism 42 located in the dispensing zone arranged to selectively crush ice, an ice shaving mechanism 44 located in the dispensing zone arranged to selectively shave ice, the control mechanism 40 also arranged to selectively activate the ice crushing mechanism and the ice shaving mechanism upon receipt of an appropriate input from a user via the user interface 39 which may include selection switches 47 located in or near the dispenser 30. A dispensing outlet 48 may also be provided where the ice in the form of cubes, crushed ice or shaved ice is dispensed to the user through the door 28 of the refrigerator 20 at the dispenser 30. In an alternate embodiment, the ice, either cubed, crushed or shaved may be dispensed to a container located within the refrigeration appliance. The reservoir 36 and the dispensing zone 38 may be physically assembled as a single unit, removable and attachable to the refrigeration appliance 20 in one piece, or they may be constructed as separate units, joined together when assembled in the appliance.

The mechanism 34 for delivering ice may be arranged with a single, relatively linear path for the ice, as schematically illustrated in FIG. 3 or it may be arranged with a dual path for the ice, as schematically illustrated in FIG. 4.

Figure 5:
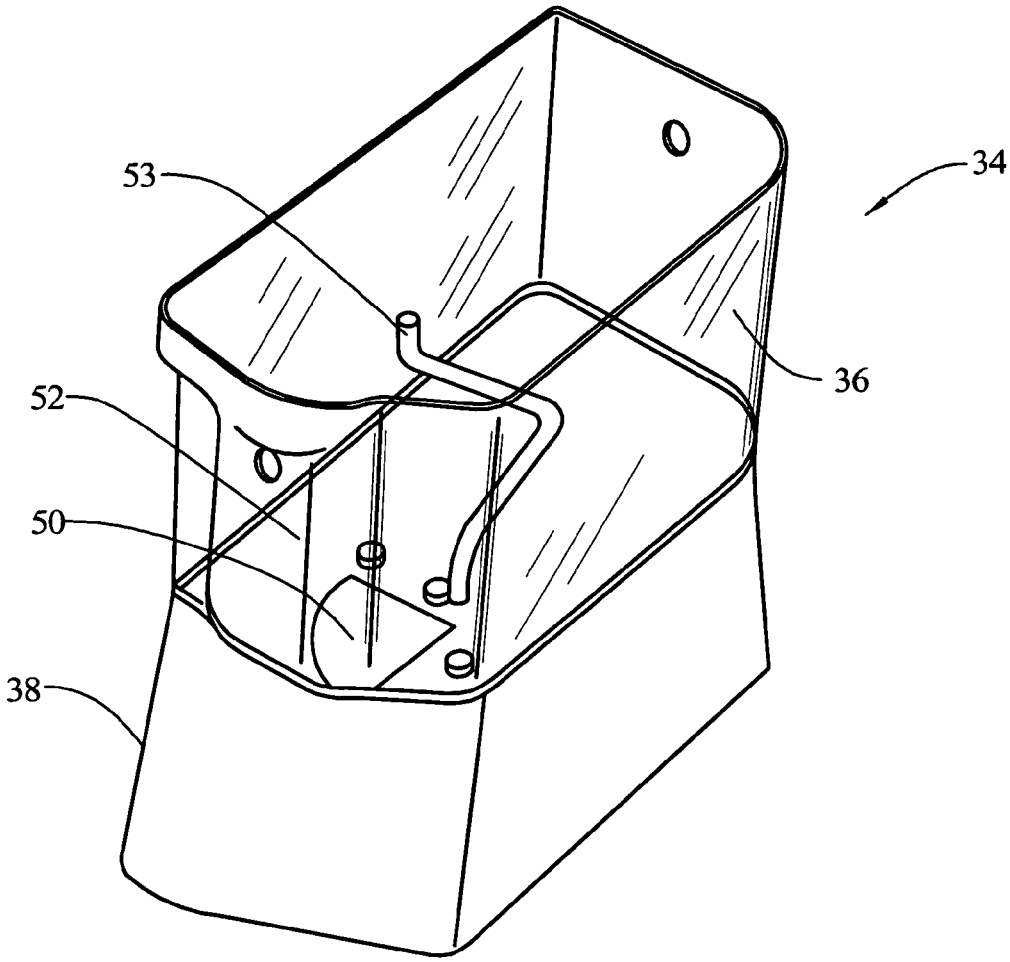
FIG. 5 is a perspective view illustrating the mechanism in a single well configuration.
Figure 6:
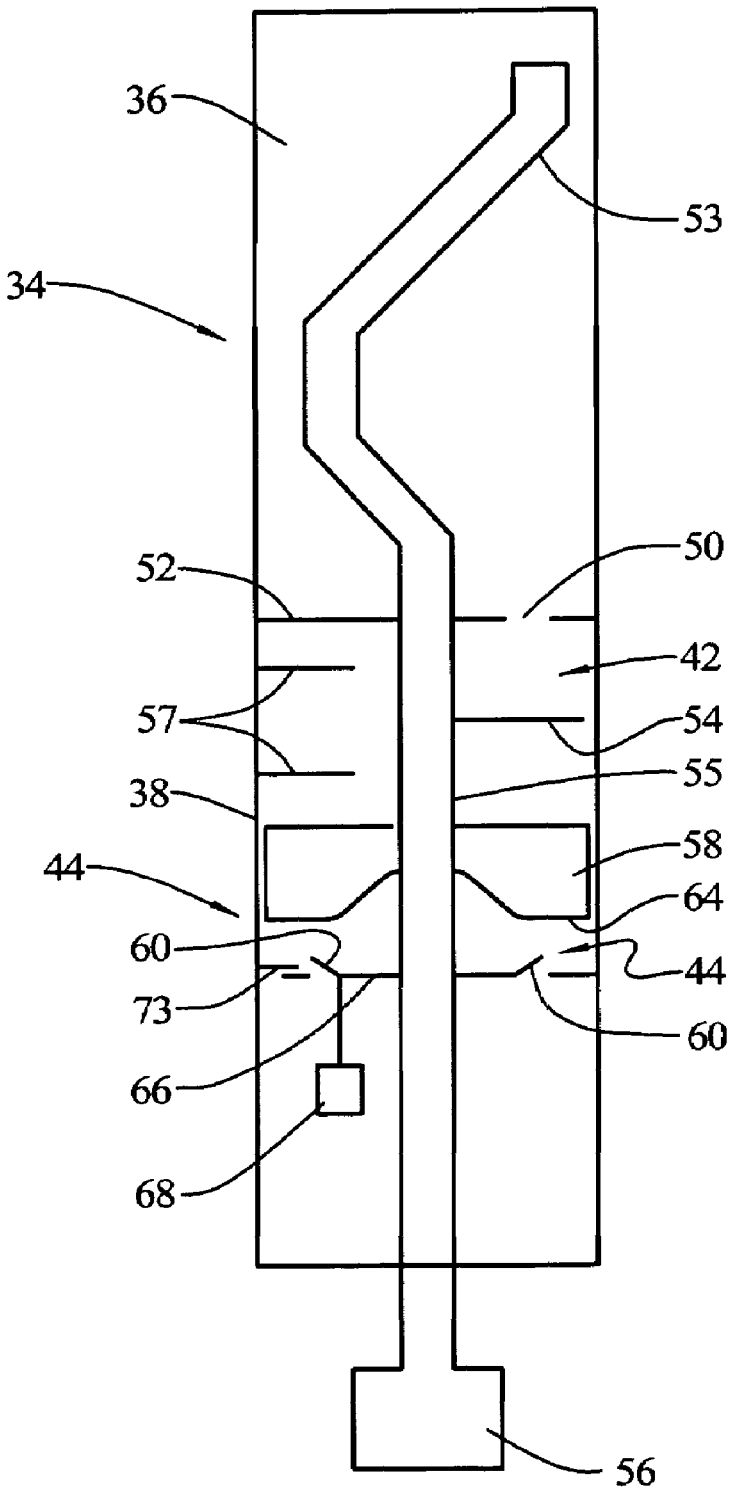
FIG. 6 is side cross sectional schematic illustration of an embodiment of the mechanism components in the single well configuration.
Figure 7:
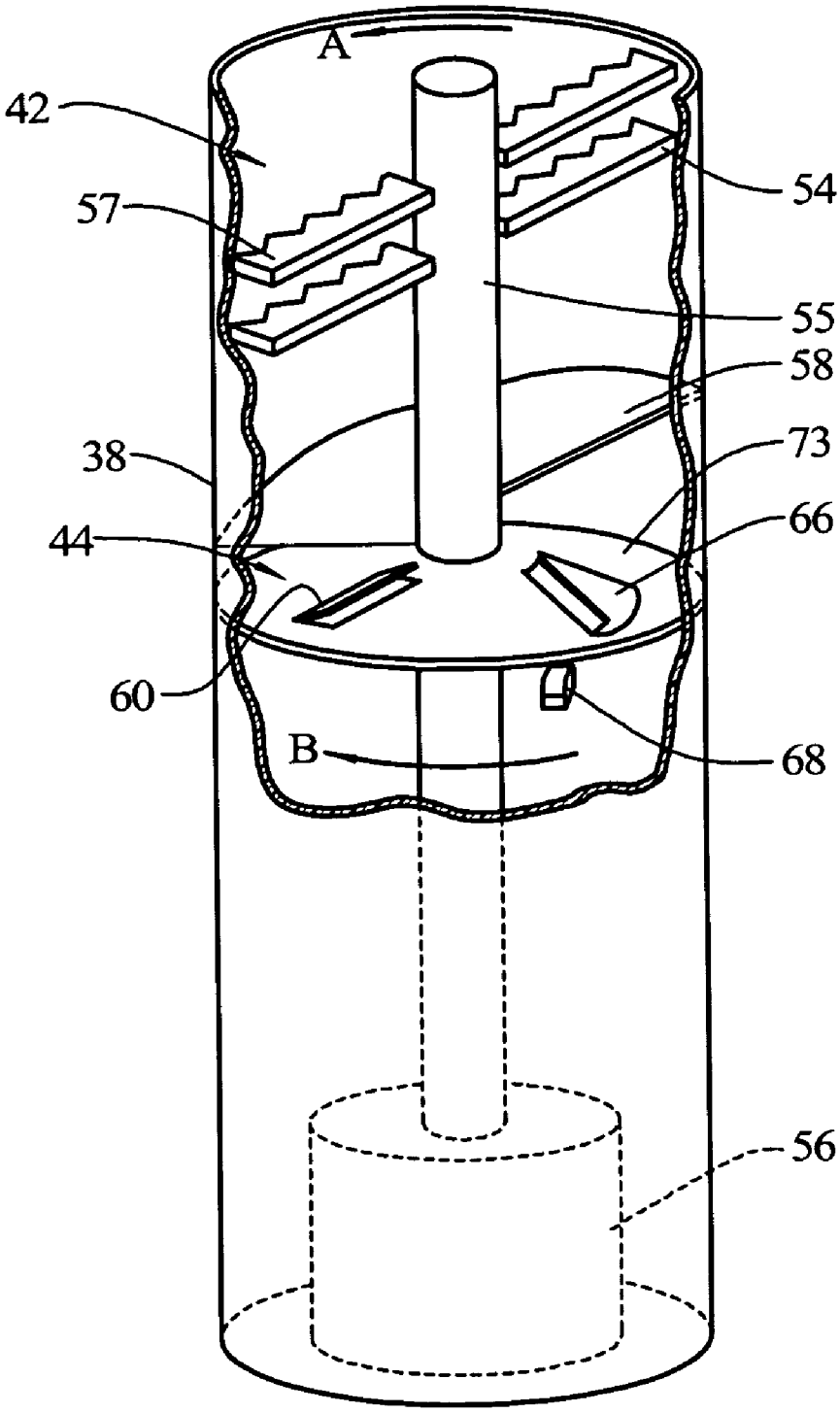
FIG. 7 is a top perspective view of the embodiment illustrated in FIG. 6.
Figure 8:
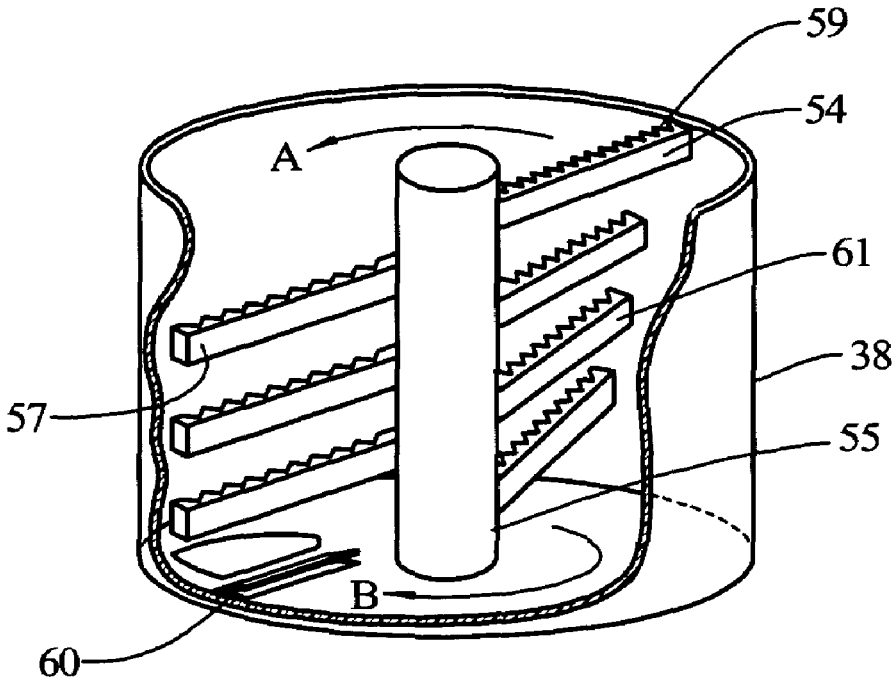
FIG. 8 is a partial top perspective view of an embodiment of the mechanism in a single well configuration.
Figure 9:
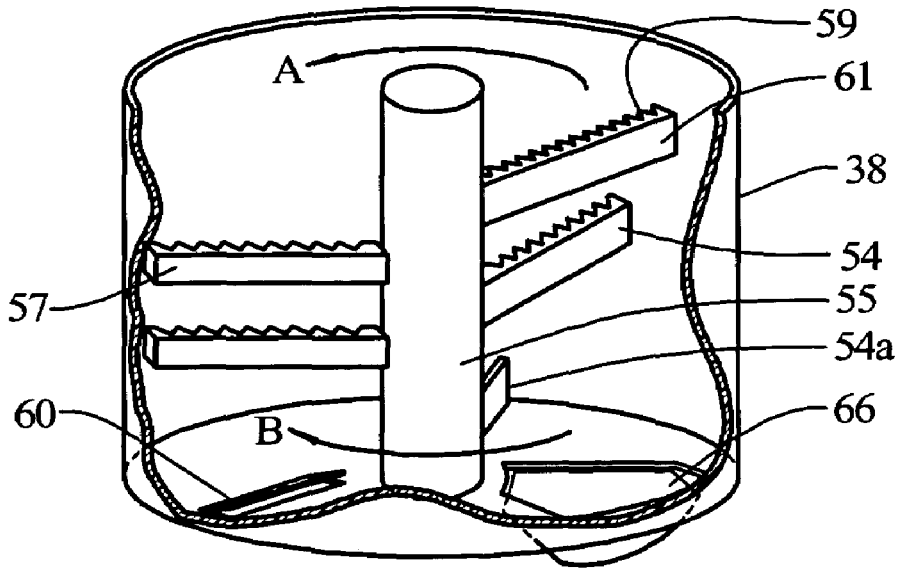
FIG. 9 is a partial top perspective view of an embodiment of the mechanism in a single well configuration.
Figure 10:
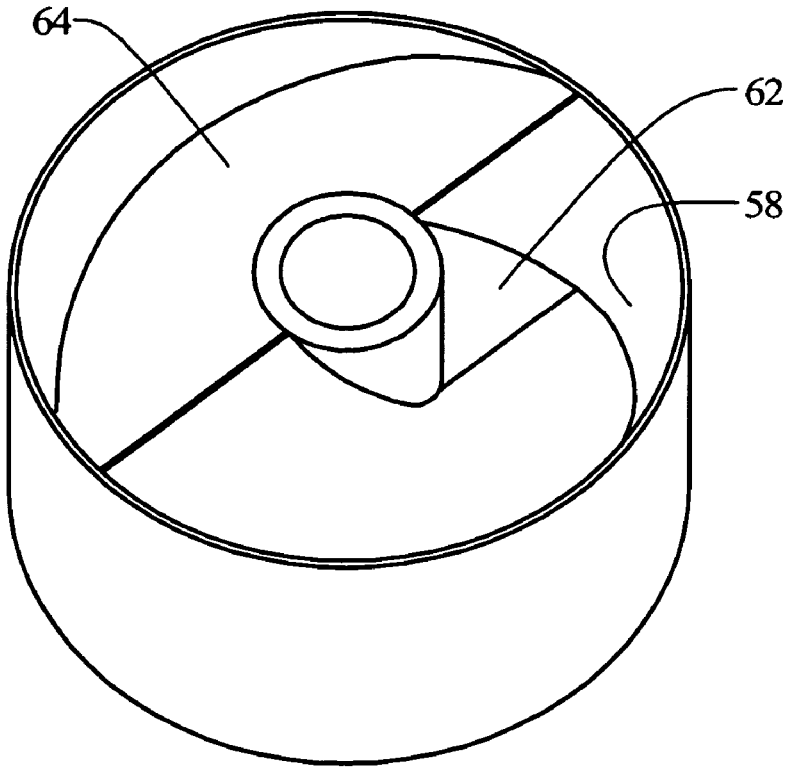
FIG. 10 is a top view illustrating the ice pusher component in isolation.
Figure 11:
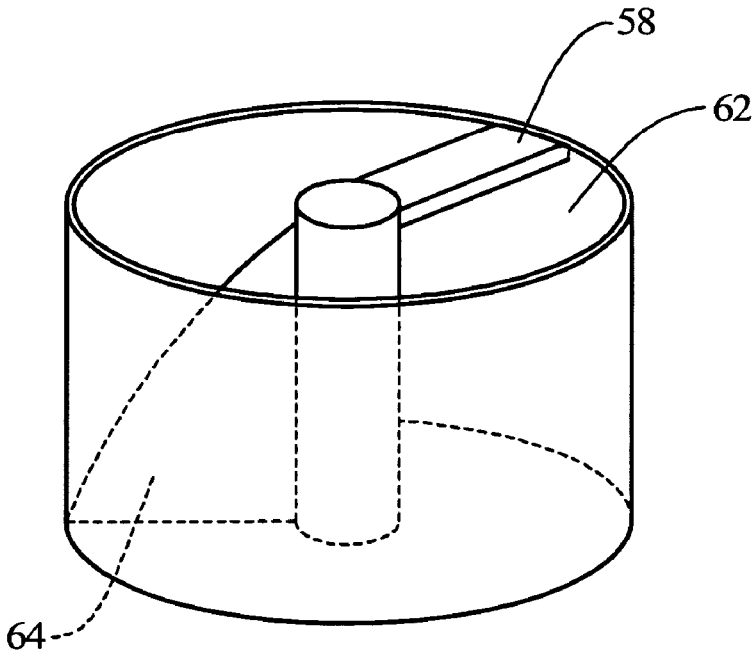
FIG. 11 is a top perspective view illustrating the ice pusher component in isolation.
Figure 12:
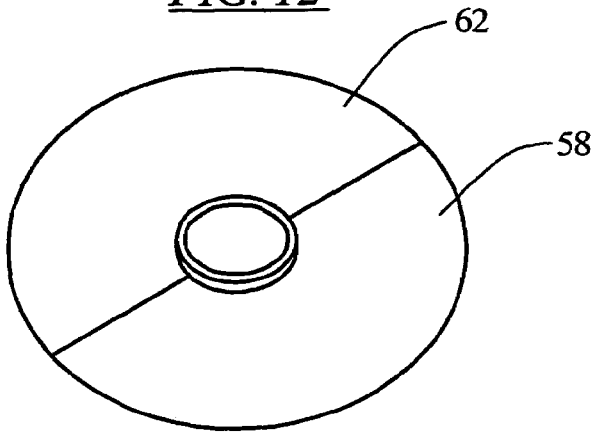
FIG. 12 is a top view of an embodiment of the ice pusher component in isolation.
Figure 13:
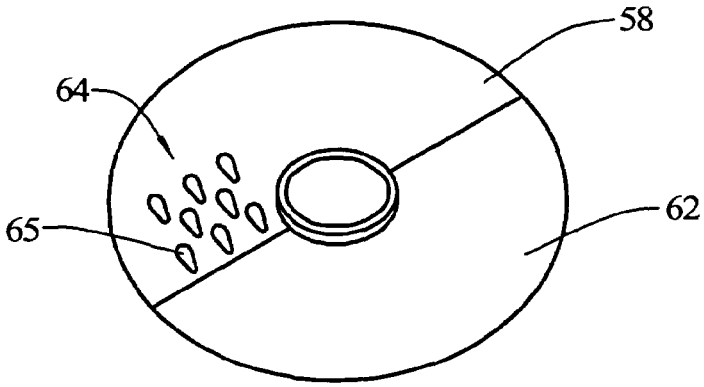
FIG. 13 is a bottom view of an embodiment of the ice pusher component in isolation.

In the single path arrangement, as schematically illustrated in FIG. 3, and also in FIGS. 5-7 and referred to as a single well configuration, all of the ice passes along the same path, regardless of whether it is delivered as ice cubes, crushed ice or shaved ice.

Generally, ice, in the form of cubes, which may have been made in an ice forming unit 49 associated with the appliance 20 that the mechanism 34 is located within, is dispensed from the ice forming unit to an ice storage reservoir 36. Ice may be transported to the reservoir 36 from the ice forming unit 49 by gravity or some other known delivery mechanism. The ice accumulates in the reservoir 36 until the user makes a demand for the ice. Known shut off mechanisms may be provided to terminate the formation of additional ice by the ice forming unit 49 when the reservoir has reached its capacity. The reservoir 36 may have an opening 50 in a bottom side 52 thereof through which the ice passes into the dispensing zone 38 as one form of delivery mechanism. Such an arrangement would allow for a gravity feed of the ice into the dispensing zone 38. An ice stirring arm 53, or an ice moving auger (another type of delivery mechanism used, particularly if the ice is delivered to the dispensing zone 38 horizontally rather than vertically) may be provided to assist in moving the ice cubes from the reservoir 36 to the dispensing zone 38 and to prevent ice bridges from forming.

Positioned within the dispensing zone 38 is the ice crushing mechanism 42 and the ice shaving mechanism 44 (FIGS. 3,6 and 7). The ice crushing mechanism 42 may be a commonly used arrangement wherein one or more rotating fingers 54 are driven by a motor 56 to crush ice cubes between the finger and a fixed part 57 of the mechanism, such as taught in U.S. Pat. Nos. 4,176,527, 5,050,777, 6,050,097 and 6,082,130, the disclosures of each being incorporated herein by reference.

An example of such an arrangement is illustrated in FIGS. 6-9 wherein a rotating arm 55 is provided with fingers 54 extending radially inside the dispensing zone 38. One side 59 of the fingers 54 has serrated teeth, the other side 61 is an extended, smooth surface. In the crushing mode, the motor 56 rotates the arm 55 in a first direction A and the serrated fingers 54 grab and crush the cubes against a stationary grate 57 in the dispensing zone 38. In a shaving mode, the motor 56 turns the arm 55 in the opposite direction B and the smooth surface 61 of the fingers 54 push cubes against a cutting blade 60. In an ice cube dispensing mode, the motor 56 turns the same direction B as for shaving and ice exits through a trap door 66. A sweep finger 54*a* (FIG. 9) could be provided to push ice fragments formed by the crusher fingers 54 through the open trap door 66 for dispensing.

As shown in FIGS. 6 and 7, the ice shaving mechanism 44 may include an impeller or ice pusher 58 pushing the ice over the shaving blade 60 or multiple blades. The same motor 56 that drives the crushing finger 54 may drive the ice pusher 58, or if desired, a separate motor may be used.

An embodiment of the ice pusher 58 is shown in isolation in FIGS. 10-13 where it is seen that there is at least one passage 62 therethrough for the ice and a lower side ramped surface 64 for camming the ice against the shaving blade 60. The ice pusher 58 may include one or several helical blades forming the lower side ramped surface 64. Also, the lower side ramped surface 64 may be specially modified, for example being provided with surface features 65 such as bumps, grooves or coatings to grip and hold the ice cubes against the shaving blade 60 and to prevent the ice cubes from jamming. The ice pusher 58 may be removable from the mechanism to permit cleaning and replacement, if necessary.

Figure 14:
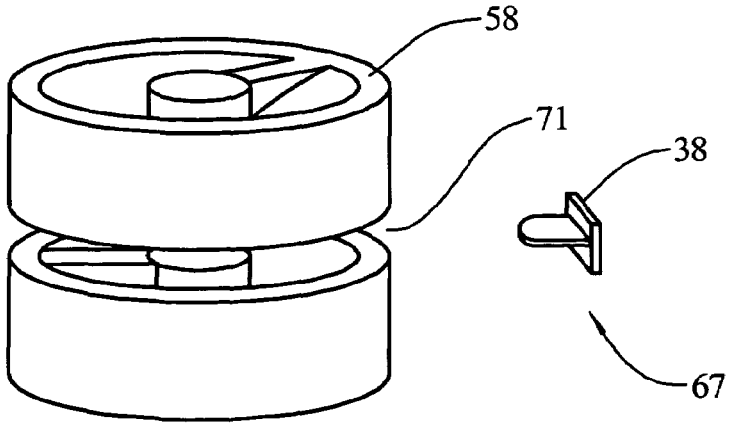
FIG. 14 is a side perspective view of an embodiment of the ice pusher component in isolation.

As shown in FIG. 14, the dispensing zone 38 may include one or more protrusions 67 for activating or jostling the ice cubes during the rotation of the ice pusher 58. These protrusions 67 may be formed on the side walls of the dispensing zone 38, such as in the form of fingers which protrude into a slot 71 in the ice pusher 58. Such protrusions 67 may be separately attached or may be formed integrally with the walls of the dispensing zone 38. The protrusions 67 may also be provided at or on a surface against which the ice cubes are pressed by the ice pusher 58, such as a surface 73 which carries the shaving blade 60. Such protrusions 67 may be used to prevent the ice cubes from jamming in the dispensing zone 38 and to improve shaving performance.

Figure 15:
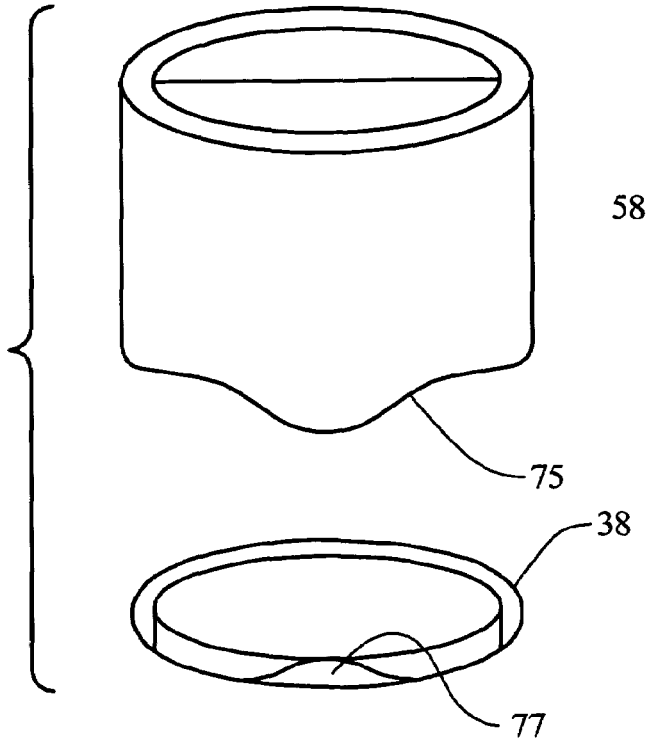
FIG. 15 is side perspective view of an embodiment of the ice pusher engaging the delivery dispensing zone.

In an alternate embodiment, the ice pusher 58 may have a lower, contoured surface 75 arranged to ride on a cam surface 77 (FIG. 15) of the dispensing zone 38 which results in the ice pusher moving one or more vertical cycles during each revolution of the ice pusher. This vertical movement will have the effect of "vibrating" the ice pusher 58 at a high frequency to discourage ice cube jamming.

To have the ice cubes avoid the shaving mechanism 44, and to deliver only ice cubes or crushed ice, there may be provided the trap door or bypass door 66 (FIGS. 6, 7 and 9), such as at the surface 73 that carries the shaving blade 60. A solenoid 68 or some other mechanical or electromechanical device may be used to open the bypass door 66, as controlled by the control mechanism 40. Also, the ice shaving mechanism 44 may be placed upstream (towards the ice reservoir 36) of the ice crushing mechanism 42 in an alternate embodiment. The blade 60 or blades of the ice shaving mechanism 44 may be turned, while the ice pusher 58 is held stationary, or both may move. The driving force for either or both of the blades 60 (if movable) and the ice pusher 58 (if movable) may be the motor 56 used for ice crushing, or a separate motor or motors may be utilized.

Figure 16:
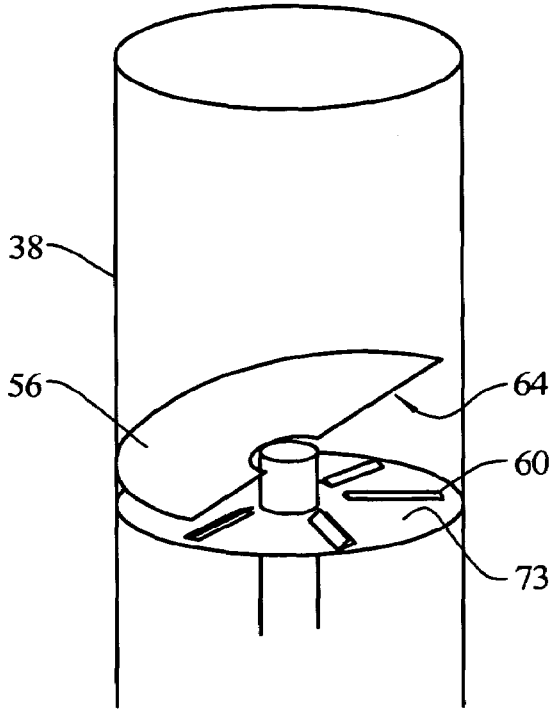
FIG. 16 is a side perspective view of an embodiment of the ice pusher and shaving plate in the dispensing zone.

In an alternative embodiment, as shown in FIG. 16, the ice pusher 58 may be stationary and the surface 73 carrying the shaving blade(s) 60 may be rotatable. As the surface 73 is rotated, the shaving blade(s) 60 will shave the ice cubes and will also force the ice cubes into the ever smaller height between the surface 73 and the ice pusher lower side ramp surface 64. In such an arrangement, the ice pusher 58 may be a separate component, or may be formed as part of the dispensing zone 38 itself.

In order to form crushed ice as opposed to shaved ice, the shaving apparatus can be modified by increasing the height of the blade above the shaving surface, increasing the width of the slot in front of the cutting blade on the surface through which the ice exits the dispensing zone, or increasing the angle between the cutting blade and the surface carrying the blade. An example of such an arrangement is now described.

Figure 17:
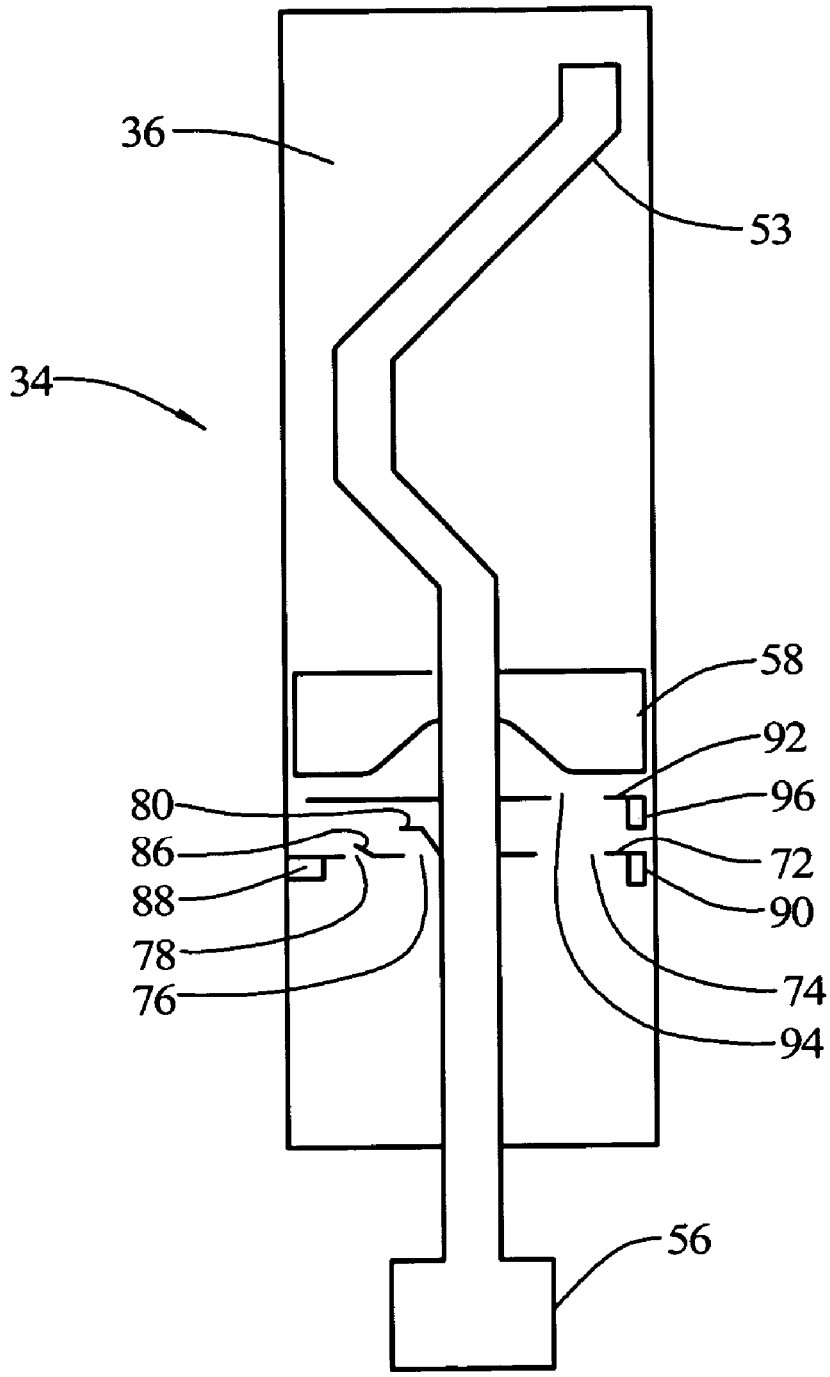
FIG. 17 is a cross sectional schematic illustration of an embodiment of the mechanism components in the single well configuration.
Figure 18:
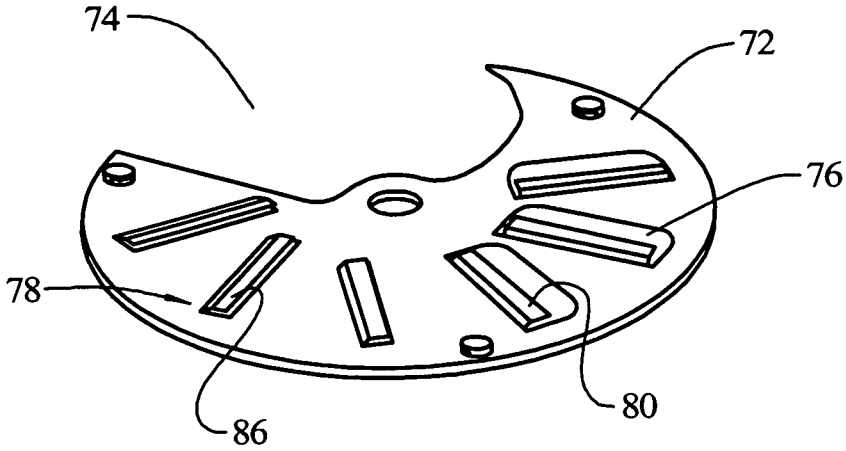
FIG. 18 is a top perspective view illustrating an embodiment of the ice form selection plate of the single well configuration.

In an embodiment of the single well arrangement schematically illustrated in FIG. 17, the ice pusher 58, such as an impeller, may be used along with a plate 72 that is rotated to a desired selection to present openings 74, 76, 78 for ice cubes, crushed ice or shaved ice, respectively. An embodiment of such a plate 72 is shown in isolation in FIG. 18. In such an arrangement, crushed ice is formed by the pusher 58 moving the ice bodies against a fixed blade-like raised edge 80 of the opening 76 in the plate 72 which is relatively larger than the opening 78 in the plate having a fixed blade-like raised edge 86 for generating shaved ice.

The plate 72 may be rotated to an angular position corresponding to a desired selection through the power of a motor 88, solenoid, or similar arrangement and various switches 90 or sensors may be used to determine the position of the plate, all as controlled by the control mechanism 40 based upon user selection. The plate 72 may alternatively be held stationary, and a cover 92 (FIG. 17) with an opening 94 therethrough may be provided that may rotate on top of the plate to reveal an appropriate portion of the plate corresponding to the desired ice type selection. Again, a motor 88, solenoid, or similar arrangement may power the rotation of the cover 92 and various switches 96 or sensors may be used to determine the position of the cover.

Figure 19:
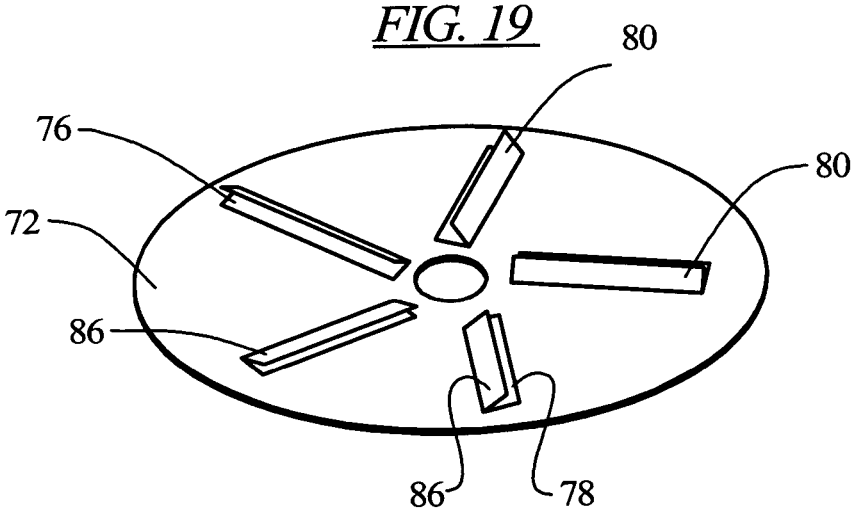
FIG. 19 is a top perspective view illustrating another embodiment of the ice form selection plate of the single well configuration.
Figure 20:
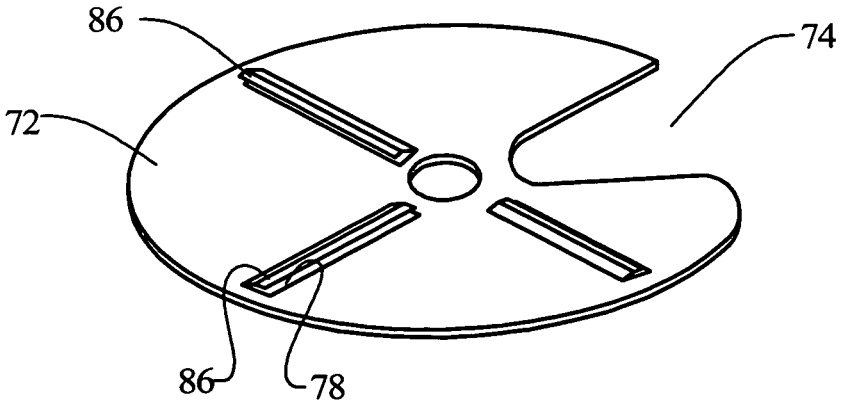
FIG. 20 is a top perspective view illustrating another embodiment of the ice form selection plate of the single well configuration.

Alternative embodiments of the plate 72 are shown in FIGS. 19 and 20. In FIG. 19, blades 80, 86 and openings 76, 78 are positioned and arranged to provide either crushed ice or shaved ice. In FIG. 20, blades 86 and opening 74 are positioned and arranged to provide either cubed ice or shaved ice.

Figure 21:
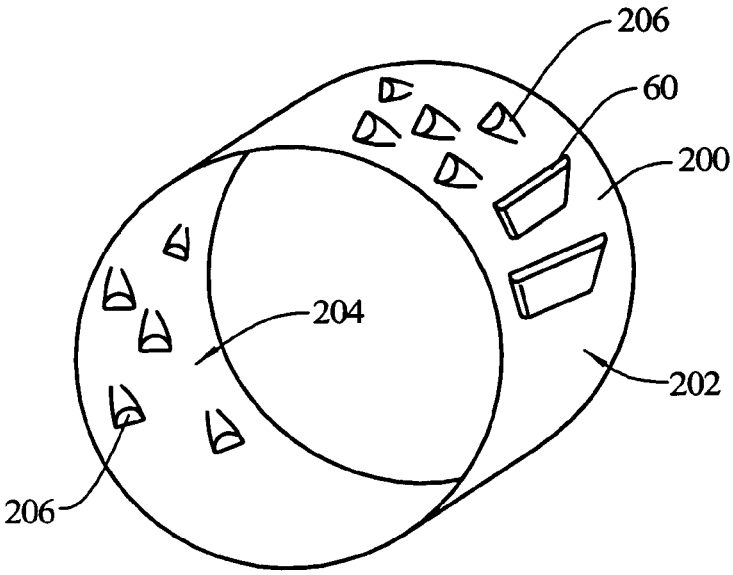
FIG. 21 is a side perspective view illustrating a cylindrical ice shaving member.
Figure 23:
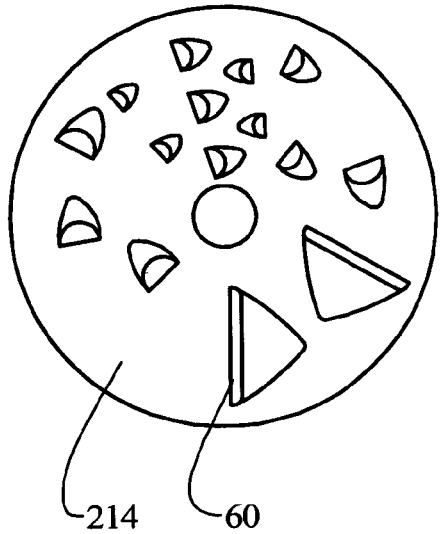
FIG. 23 is a top view illustrating a circular ice shaving member.
Figure 22:
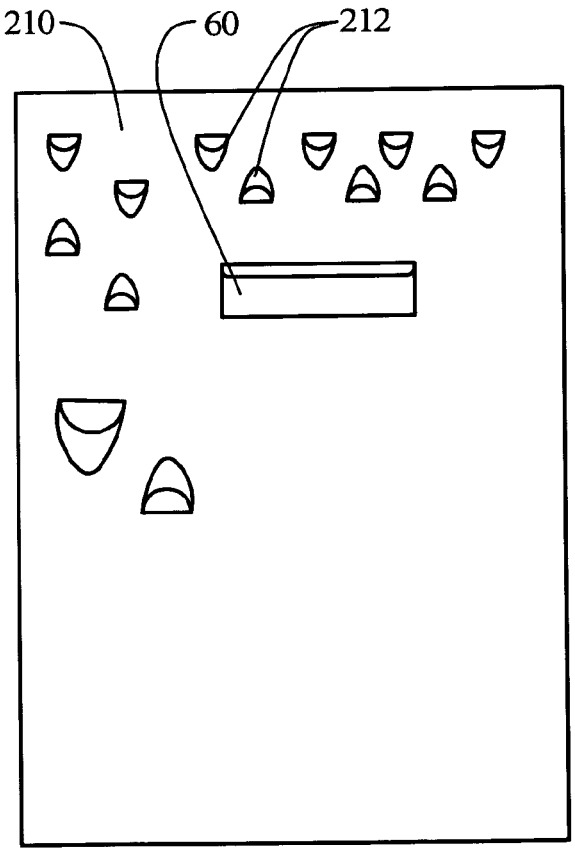
FIG. 22 is a top view illustrating a rectangular ice shaving member.

Alternative embodiments of the ice shaving mechanism are illustrated in FIGS. 21-23. In FIG. 21, a shaving mechanism utilizes a cylinder for carrying the shaving blade 60. The blade 60 can be arranged to extend from an exterior cylindrical surface 202 or from the interior cylindrical surface 204. As described above, either surface may be provided with treatments 206 such as bumps, grooves, protrusions or coatings to grip, hold and feed ice cubes against the cutting cylinder. In FIG. 22, a generally rectangular plate 210 is provided which contains the shaving blade 60 and surface treatments 212. Such a plate 210 could be received in a dispensing zone 38 having a rectangular cross section. In FIG. 23, the plate 214 carrying the shaving blade 60 is circular in shape, allowing it to fit in a cylindrical dispensing zone 38, and to rotate if desired.

Figure 24:
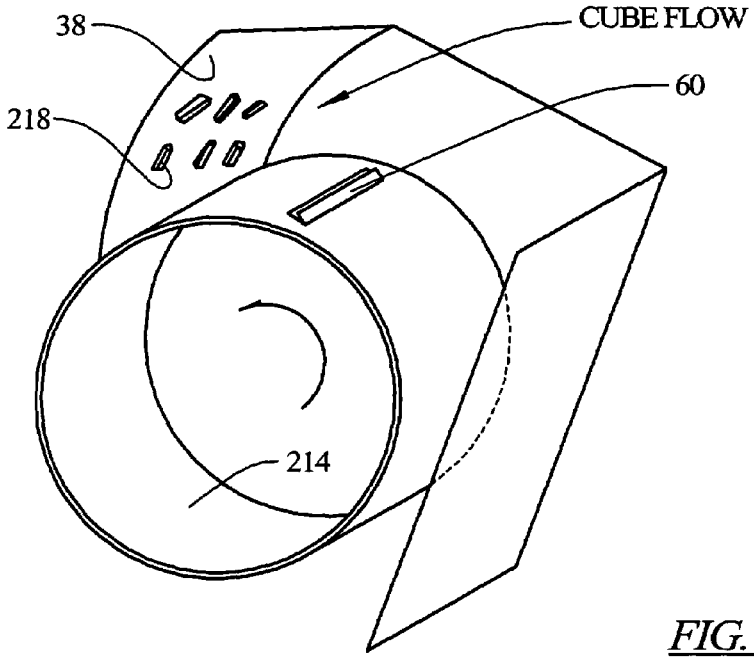
FIG. 24 is a top perspective view illustrating a portion of the ice shaving mechanism with a cylindrical ice shaving member on a horizontal axis.
Figure 25:
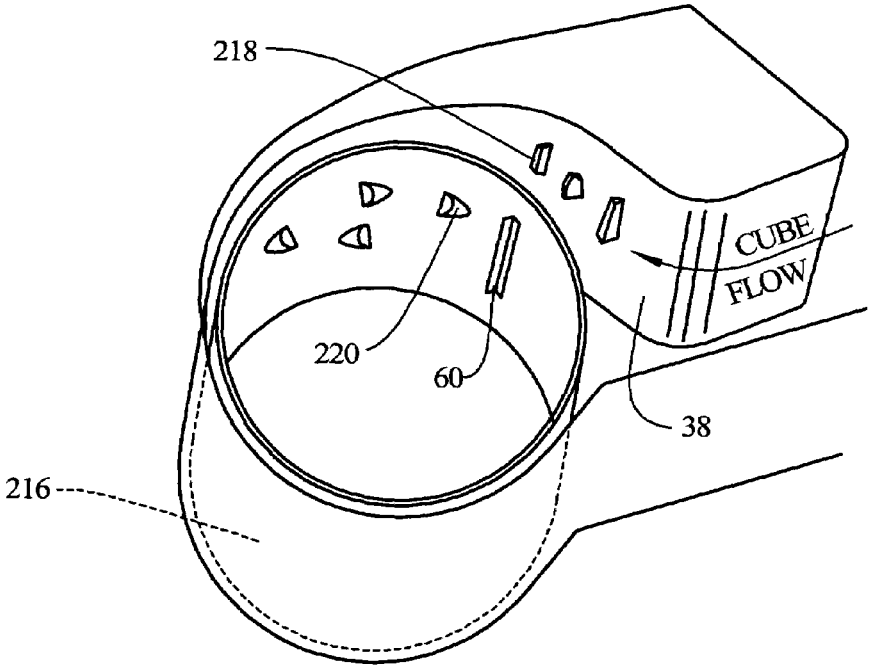
FIG. 25 is a top perspective view illustrating a portion of the ice shaving mechanism with a cylindrical ice shaving member on a vertical axis.

FIGS. 24 and 25 illustrate cylinders 214, 216 used to carry the shaving blade 60, and also illustrate various surface treatments 218, 220 formed on the walls of the dispensing zone 38 as well as the on the cylinder 216.

Figure 26:
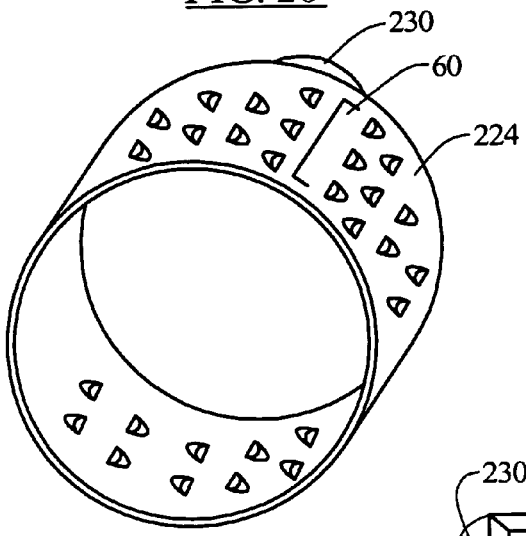
FIG. 26 is a side perspective view illustrating a cylindrical ice shaving member with a cam surface.
Figure 28:
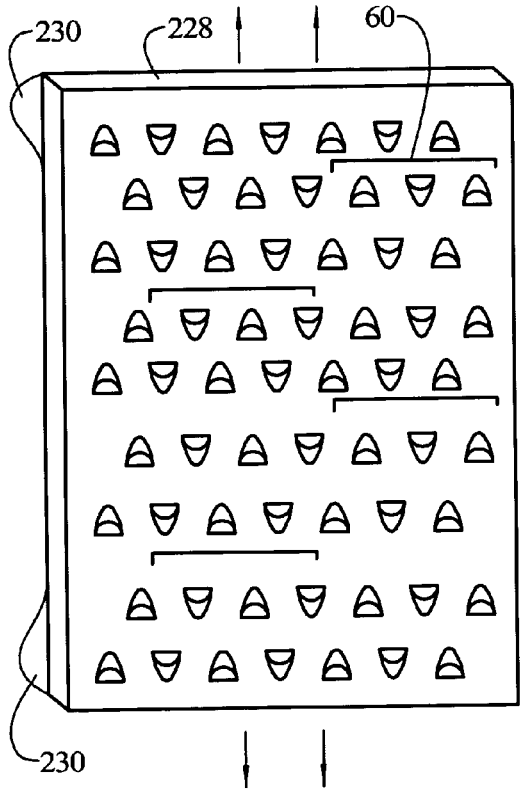
FIG. 28 is a top perspective view illustrating a rectangular ice shaving member with a cam surface.
Figure 27:
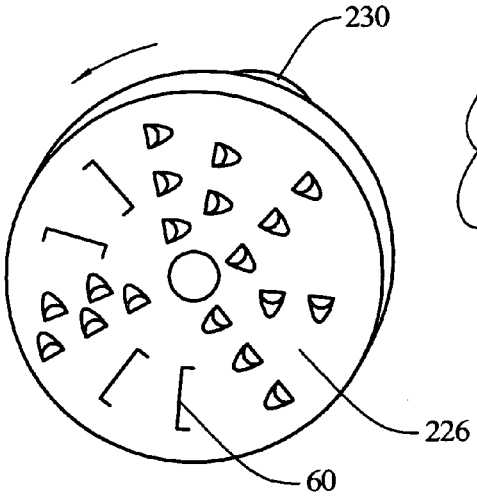
FIG. 27 is a top perspective view illustrating a circular ice shaving member with a cam surface.

FIGS. 26, 27 and 28 illustrate a shaving mechanism cylinder 224, circular plate 226 and rectangular plate 228, respectively, which are also provided with cams 230 used to induce oscillation of the cutting blade carrying member to assist in preventing cube jamming during the shaving operation, as described above.

Figure 29:
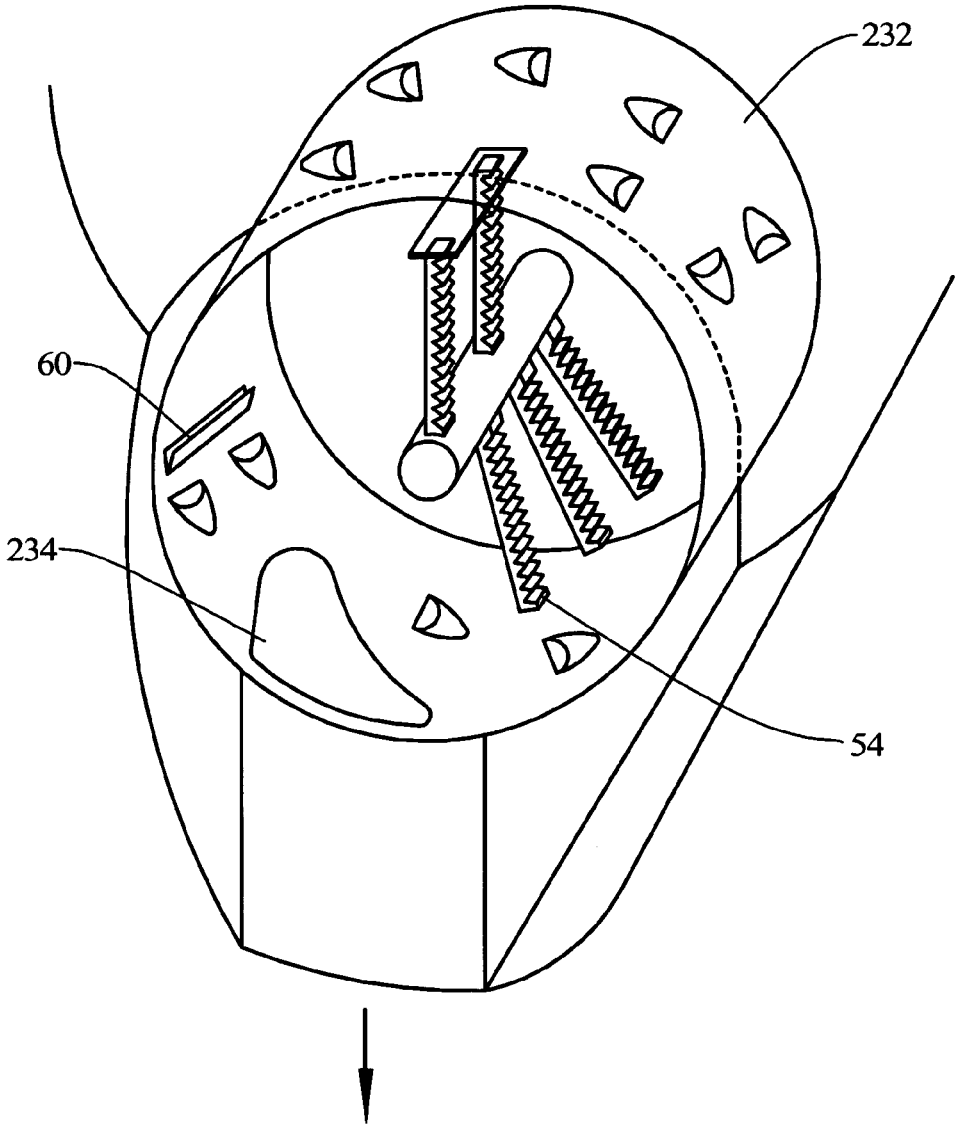
FIG. 29 is a top perspective view illustrating a portion of the ice shaving mechanism with a cylindrical ice shaving member on a horizontal axis.

FIG. 29 illustrates a cylinder 232 carrying a shaving blade 60, with a trap door 234 provided in the cylinder for allowing the passage of ice cubes or crushed ice when open, and the formation of shaved ice when closed. A crushing mechanism with rotating fingers 54, as described above is provided in the interior of the cylinder 232 carrying the shaving blade 60.

Figure 30:
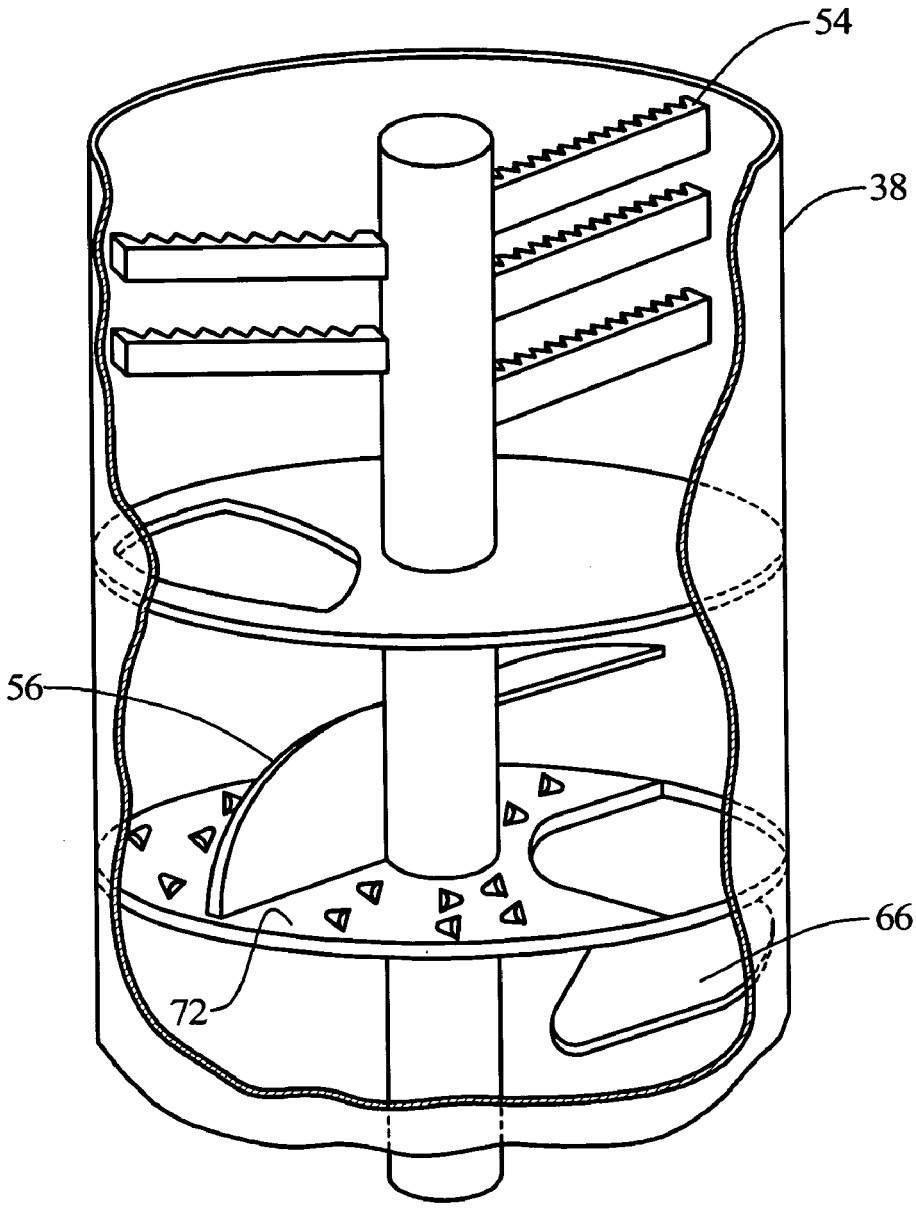
FIG. 30 is a top perspective illustration of an embodiment of the mechanism components in the single well configuration.

FIG. 30 illustrates a mechanism for producing crushed ice with rotating fingers 54, shaved ice with a circular plate 72 and cubed ice with an openable trap door 66. In this embodiment, either the circular plate 72 or the ice pusher 56 may rotate relative to the other and to the dispensing zone 38.

Figure 31:
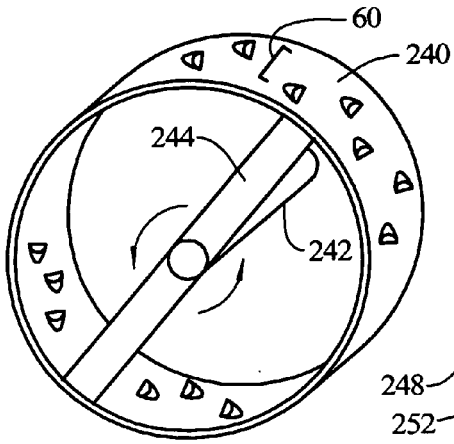
FIG. 31 is a side perspective view illustrating a cylindrical ice shaving member with an interior driving axle.
Figure 32:
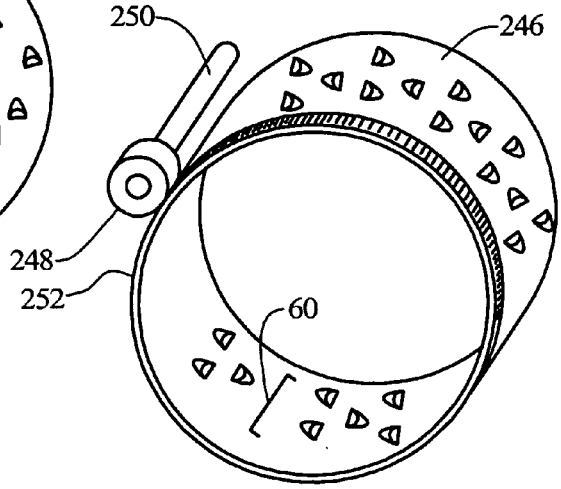
FIG. 32 is a side perspective view illustrating a cylindrical ice shaving member with an exterior driving axle.
Figure 33:
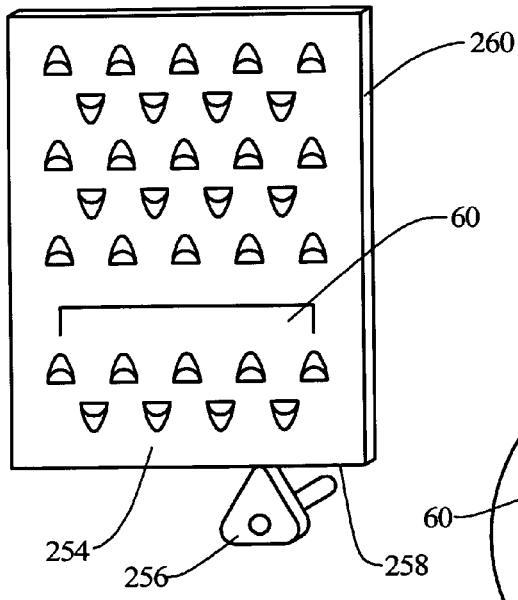
FIG. 33 is a top perspective view illustrating a rectangular ice shaving member with a rotating cam.
Figure 34:
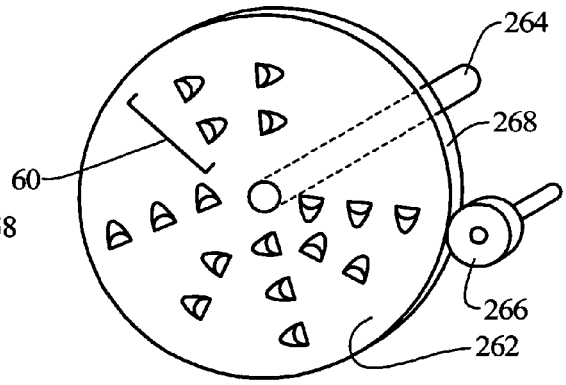
FIG. 34 is a top perspective view illustrating a circular ice shaving member with a central or an outer drive mechanism.

FIGS. 31-34 illustrate different mechanisms for driving the shaving blade carrying member in different fashions. In FIG. 31, a cylinder 240 carrying the shaving blade 60 is rotated from a central axially extending shaft 242 connected to the cylinder via a spider 244. In FIG. 32, a cylinder 246 carrying the shaving blade 60 is rotated externally by a rotating gear 248 carried on a shaft 250 which may engage with a ring gear 252 carried on the cylinder, for example. In FIG. 33, a rectangular plate 254 carrying the shaving blade 60 is caused to oscillate due to a rotating cam 256 engaging one edge 258 of the plate. Such a cam 256 may be provided on one of the adjacent sides 260 to cause a perpendicular oscillation of the plate, particularly when the cutting blade 60 is oriented perpendicularly from what is shown. FIG. 34 illustrates a circular plate 262 that could be rotated by means of a central axle 264 or by means of a wheel 266 engaging a periphery 268 of the plate.

Figure 35:
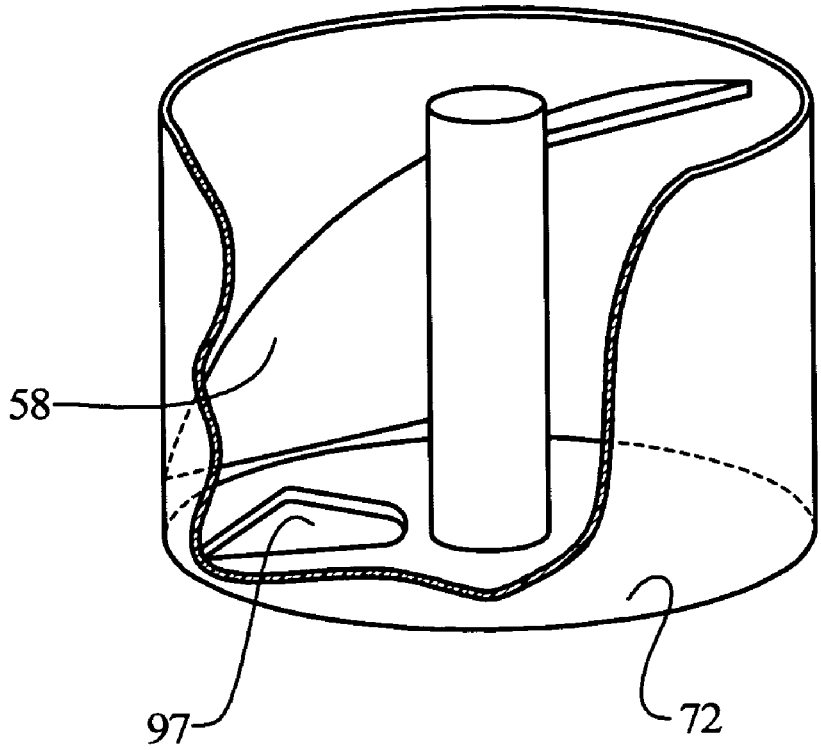
FIG. 35 is a side perspective view of an embodiment of the ice pusher and shaving plate in the dispensing zone.
Figure 36:
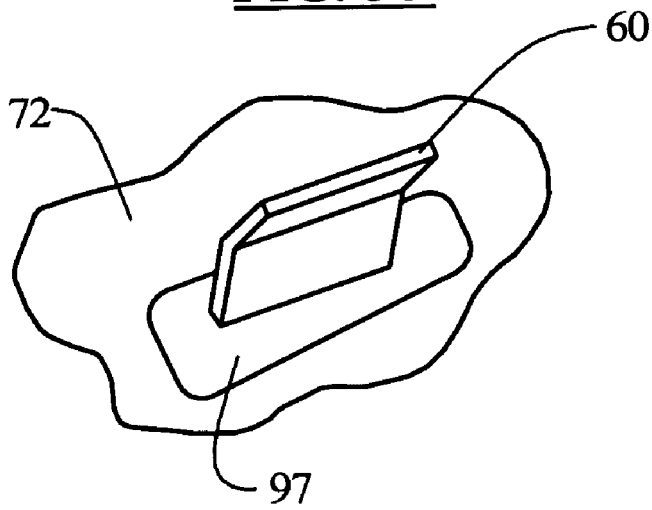
FIG. 36 is a top perspective view of the adjustable height shaving blade used in the embodiment of FIG. 35.

As illustrated in FIGS. 35 and 36, various ice sizes can be produced by moving the position of the cutting blade 60 within an opening 97 in the floor or plate 72 positioned below the ice pusher 58. If the cutting blade 60 is moved down, so that the opening 97 is unobstructed, cubes will be permitted to pass through the opening, to be dispensed whole. If the cutting blade 60 is moved up to be positioned slightly above the surface 72, shaved ice will be directed through the opening 97. If the cutting blade 60 is moved up further, thicker slices of the ice cubes will result, thus forming crushed ice sized particles which are then directed through the opening 97.

Figure 37:
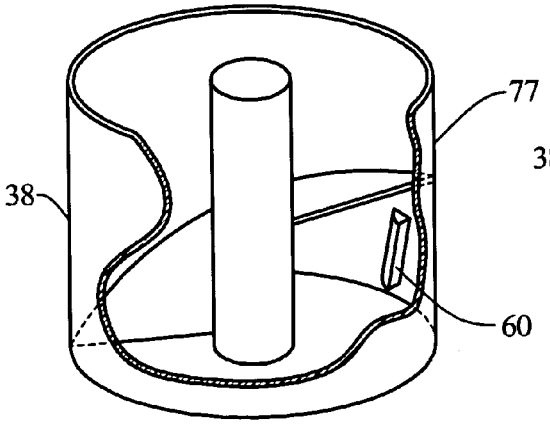
FIG. 37 is a side perspective view of an embodiment of the ice pusher and shaving blade in the dispensing zone.
Figure 38:
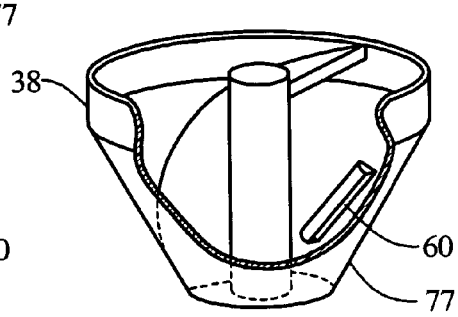
FIG. 38 is a side perspective view of an embodiment of the ice pusher and shaving blade in the dispensing zone.

In an alternate embodiment, as shown in FIGS. 37 and 38, the shaving blade or blades 60 may be provided on a side wall 77 of the dispensing zone 38 in a vertical orientation, rather than in the horizontal orientation described above. The side wall 77 of the dispensing zone 38 may either be in the form of a regular cylinder as shown in FIG. 37 or may have an inverted frusto-conical shape as shown in FIG. 38.

Figure 39:
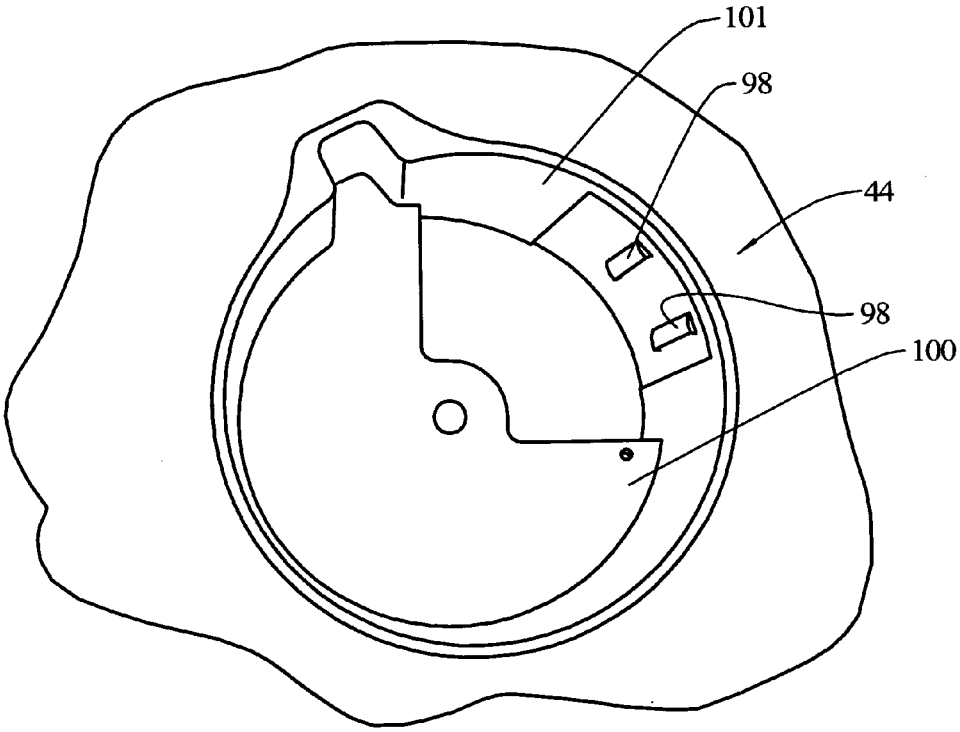
FIG. 39 is a top perspective view illustrating a portion of the ice shaving mechanism.

FIG. 39 illustrates another embodiment of a single well configuration in which one or more blades 98 for forming shaved ice are provided on a side wall 100 of the ice shaving mechanism 44. Attachments on the movable arms 54 of the ice crusher mechanism 42 may force ice bodies past the blades 98 when the mechanism is being operated in the shaved ice mode, and a door operated by a motor or solenoid may close the ice dispensing zone opening 101 to ensure only shaved ice dispensing.

By utilizing various components described above, a mechanism may be provided that produces solely shaved ice, shaved and crushed ice, shaved and cubed ice or shaved, crushed and cubed ice, all through a single dispensing zone or well. Cubed ice may be provided by operating the motor 56 at a low speed, crushed ice by operating the motor at a medium speed, and shaved ice by operating the motor at a high speed.

Figure 40:
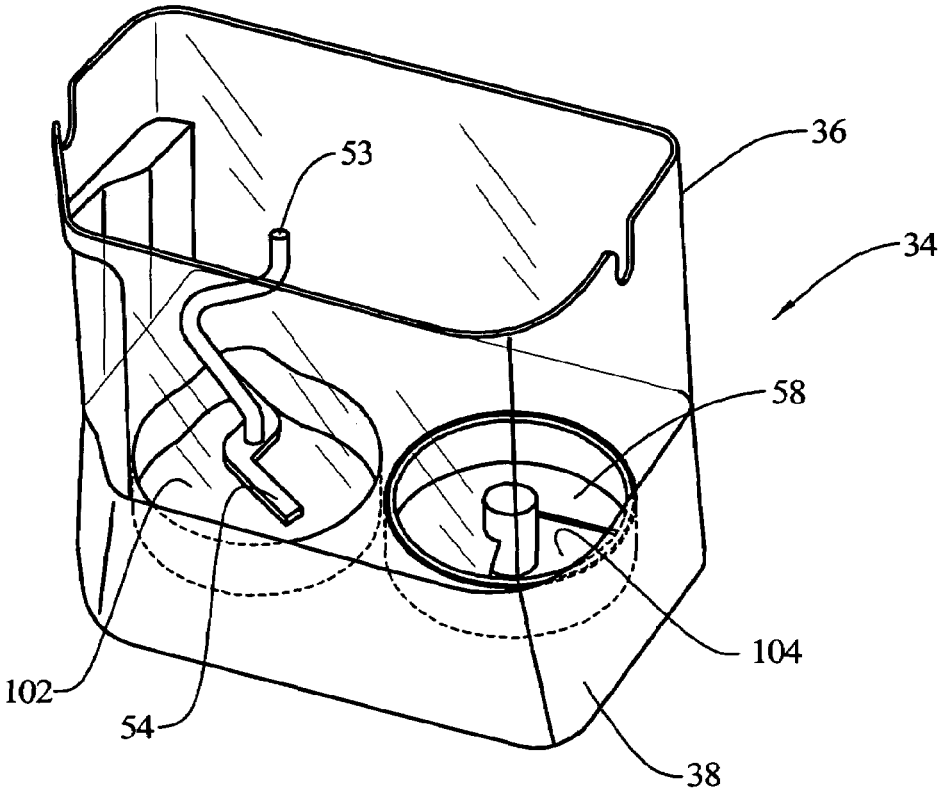
FIG. 40 is a top perspective view illustration of the mechanism in a two well configuration.
Figure 41:
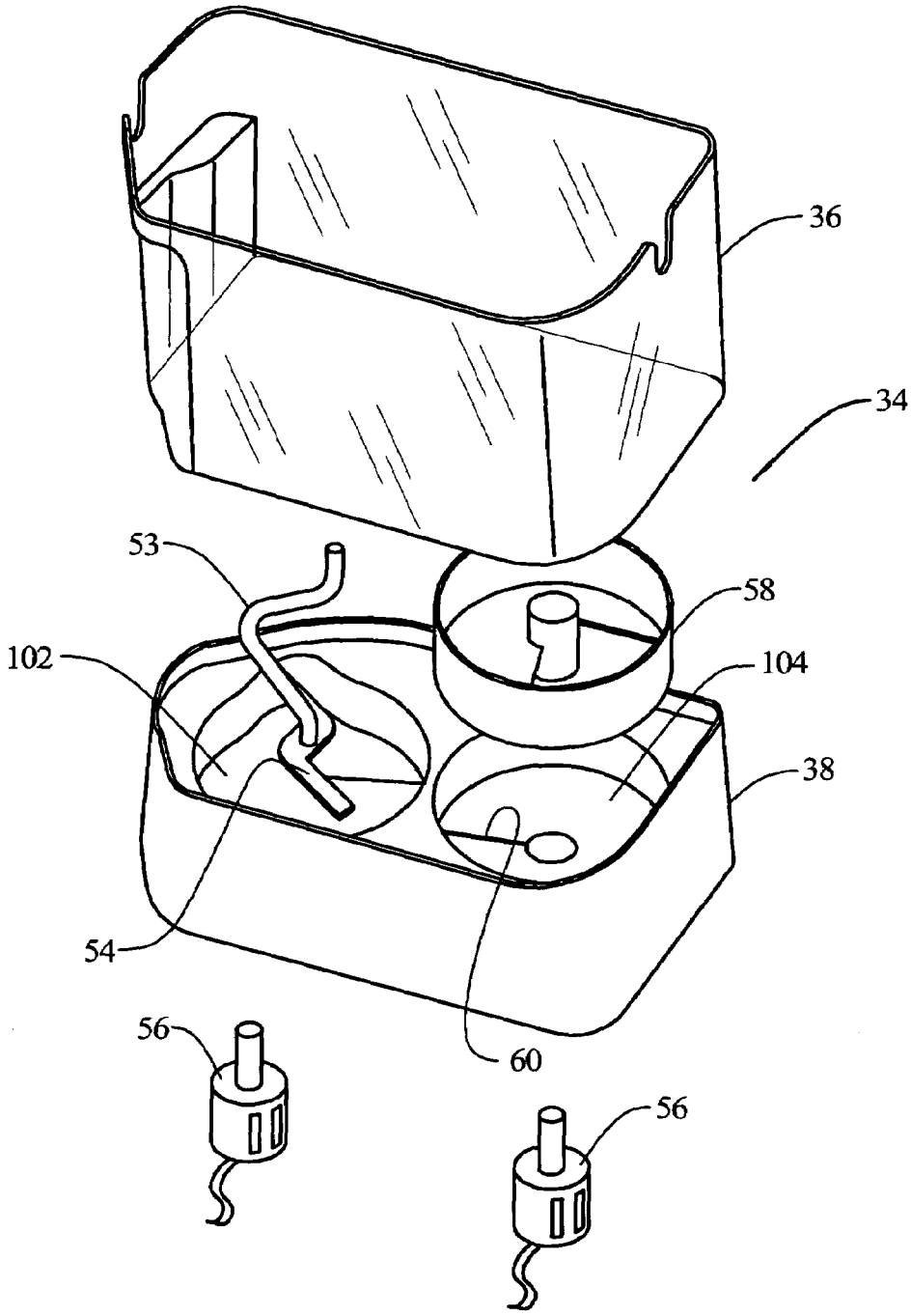
FIG. 41 is a top perspective exploded illustration of the mechanism of FIG. 40.
Figure 42:
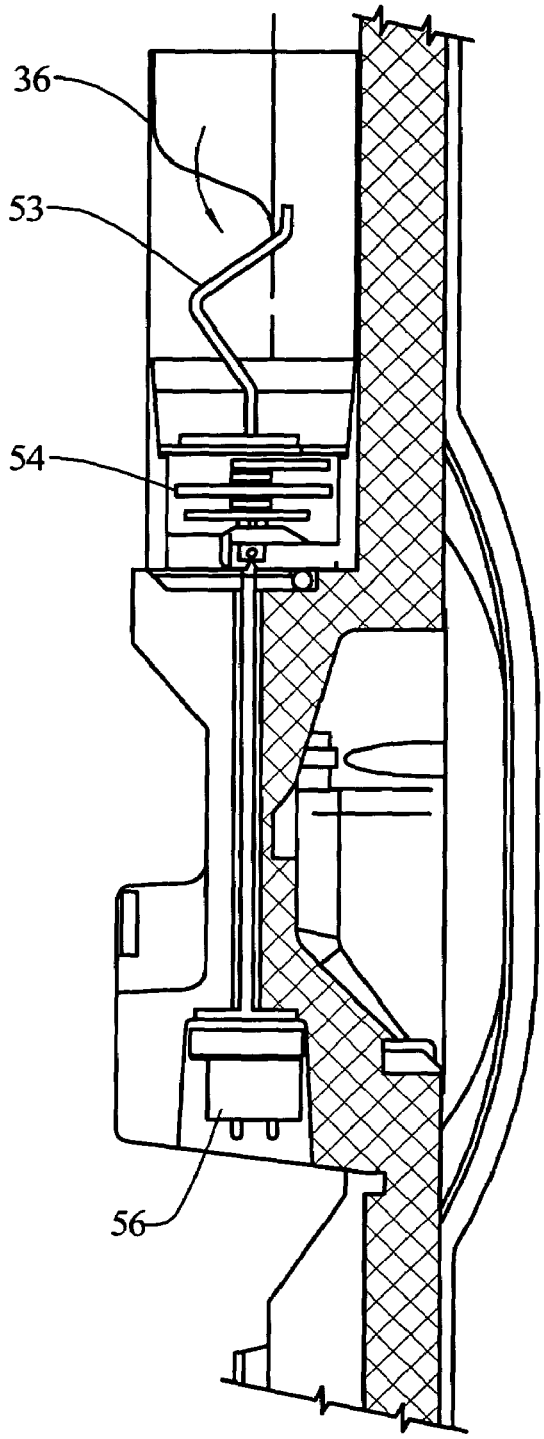
FIG. 42 is a side cross sectional schematic illustration of the ice crushing mechanism components in the two well configuration.

In the two well embodiment, as schematically shown in FIG. 4 and in FIGS. 40-42, two types of ice products may be delivered through one well and the third type of ice product may be delivered through the other well. For example, ice cubes and crushed ice may be delivered through one well and shaved ice may be delivered through the other well.

In the two well arrangement, many of the individual components are the same as described above, however, they are arranged in a two path configuration, rather than a single path. Below the ice reservoir 36, one well 102 may be arranged as a conventional dispenser for cubed and crushed ice, having the ice stirrer 53 and the movable crushing arm 54, while the other well 104 may include the pusher 58 to drive ice over the fixed ice shaving blade 60. Any of the arrangements and configurations for holding the shaving blade described above can work in the double well configuration. The mechanism in each well may be powered by a separate motor or a single motor 56 may be utilized to transmit torque to one well or the other well, based on the user's selection and the control mechanism 40.

Figure 43:
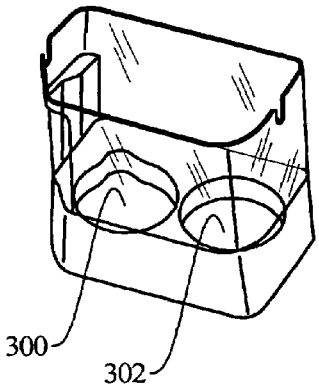
FIG. 43 is a top perspective view illustration of the mechanism in a two well configuration.
Figure 44:
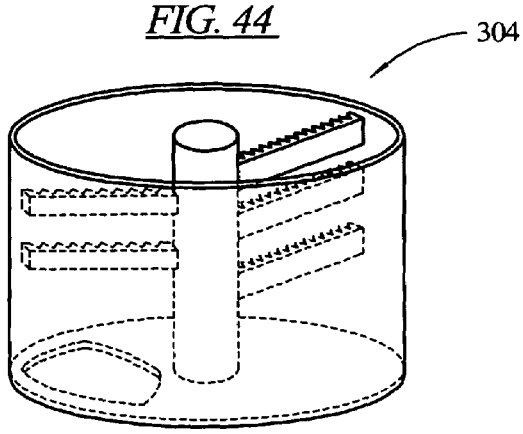
FIG. 44 is a top perspective view illustrating a portion of the ice crushing mechanism for use in the configuration of FIG. 43.
Figure 45:
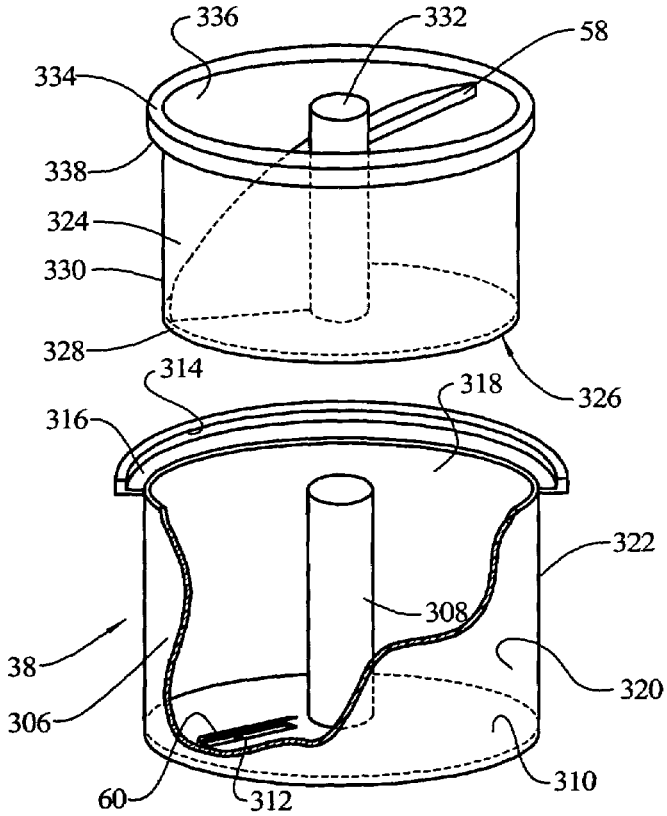
FIG. 45 is a top perspective exploded illustration of the ice shaving mechanism for use in the configuration of FIG. 43.

In an embodiment as illustrated in FIGS. 43-45, a dual well configuration is used in which cubed ice and crushed ice is delivered through the first well 300 and shaved ice is delivered through the second well 302. In the first well 300 a standard ice crushing mechanism 304 (FIG. 44) is provided, as described above. In the second well 302, as illustrated in FIG. 45, the dispensing zone 38 is formed as a cylindrical bucket 306 with a vertical center stalk 308 and a solid floor 310 carrying the cutting blade 60 positioned adjacent to an opening 312 for shaved ice to fall through adjacent to the blade. A flange 314 defining an annular groove 316 surrounds an open top 318 of the bucket 306 and a ring-like ledge 320 is formed on the floor 310 at the periphery adjacent to a vertical cylindrical wall 322 of the bucket. The ice pusher 58, in the form of a helical impeller, is carried in a cylinder 324 having an open bottom 326 carrying a low friction bearing ring 328. The helical surface of the pusher 58 extends from a cylindrical wall 330 of the cylinder 324 to a hollow center stalk 332 that is sized and arranged to engage over the stalk 308 of the bucket 306, stabilizing the pusher and preventing excessive deflection of the pusher. The bottom periphery 326 of the pusher cylinder 324 provided with the low friction ring 328 which rides on the ring-like ledge 320 of the bucket 306 as the pusher cylinder rotates relative to the bucket. The pusher cylinder 324 is provided with a flange 334 at its top open end 336 with a downwardly depending lip 338. The lip 338 is received in the groove 316 of the bucket flange 314. Thus, the pusher cylinder top 336 will be essentially flush with the top 318 of the bucket 306, thereby limiting the amount of "cube tossing" or rolling and bouncing of the cubes, during the shaving process.

Figure 46:
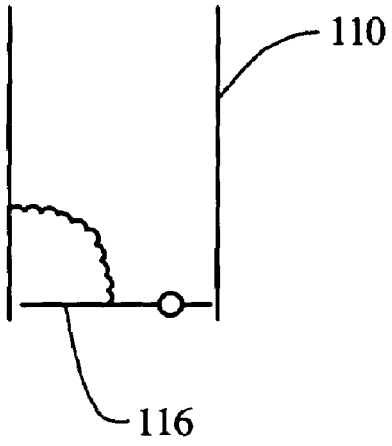
FIG. 46 is a side cross sectional schematic illustration of an embodiment of the shaved ice delivery mechanism components.
Figure 47:
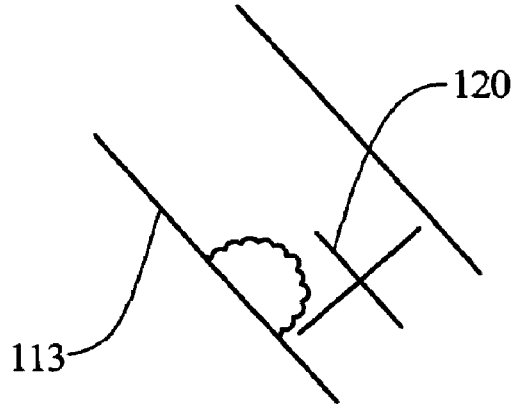
FIG. 47 is a side cross sectional schematic illustration of an embodiment of the shaved ice delivery mechanism components.
Figure 48:
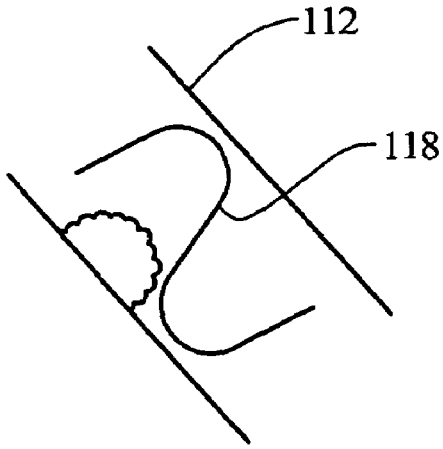
FIG. 48 is a side cross sectional schematic illustration of an embodiment of the shaved ice delivery mechanism components.

In any of the arrangements, single or double well configurations, once ice is shaved (when so selected), there are several options for delivering the ice to the dispensing outlet 48. Either a vertical passage 110 (FIG. 46) or non-vertical passage 112, 114 (FIGS. 47, 48) may be arranged to follow the ice shaving mechanism 44 leading to the dispensing outlet 48. The shaved ice may either be delivered in a continuous fashion, as it is produced, or it may be delivered in batches. In order to deliver in batches, which may be useful in some configurations to overcome friction in the passage area, a delivery mechanism in the form of a weighted or spring loaded door 116, an auger 118, paddles 120, or similar arrangements may be used. Once a predetermined batch size is produced and collected, the batch would be moved to the dispensing outlet 48 to be presented to the user.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. A refrigeration appliance comprising:

a refrigerated compartment, an ice making mechanism in said refrigerated compartment, an ice delivery system arranged to deliver ice from said ice making mechanism, and an ice shaving mechanism located in said refrigeration appliance arranged to selectively shave ice received from said ice delivery system, a control mechanism arranged to allow a user to selectively activate said ice shaving mechanism; and an ice dispensing system arranged to dispense ice, wherein ice may be dispensed in a shaved condition or a non-shaved condition.

2. A refrigeration appliance according to claim 1, wherein said non-shaved condition comprises cubed ice.

3. A refrigeration appliance according to claim 1, wherein said non-shaved condition comprises crushed ice.

4. A refrigeration appliance according to claim 1, wherein said ice is dispensed to a user through a door of said refrigeration appliance.

5. A refrigeration appliance according to claim 1, wherein said ice is dispensed to a container located within said refrigeration appliance.

6. A refrigeration appliance according to claim 1, including a reservoir arranged to receive ice from said ice making mechanism and wherein said ice shaving mechanism is located in said reservoir.

7. A refrigeration appliance according to claim 1, wherein said ice dispensing system includes a dispensing zone with an outlet and wherein said ice shaving mechanism is located in one of said dispensing zone and outlet.

8. A refrigeration appliance according to claim 1, wherein said dispensing system is arranged to dispense shaved ice from said refrigeration appliance.

9. A refrigeration appliance according to claim 1, wherein said dispensing system is further arranged to dispense cubed ice from said refrigeration appliance.

10. A refrigeration appliance according to claim 1, wherein said dispensing system is further arranged to dispense crushed ice from said refrigeration appliance.

11. A refrigeration appliance according to claim 1, wherein said dispensing system is further arranged to dispense liquid water from said refrigeration appliance.

12. A mechanism according to claim 1, including an ice crushing mechanism located in said refrigeration appliance arranged to selective crush ice received from said ice delivery system, wherein said ice crushing mechanism comprises an arm rotatably driven by a motor.

13. A mechanism according to claim 1, wherein said ice shaving mechanism comprises a pusher rotatably driven by a motor for pushing ice and a fixed blade against which said ice is pushed by said rotating pusher.

14. A mechanism according to claim 1, wherein said ice shaving mechanism comprises a pusher and a blade, at least one of which is rotated relative to the other by a motor.

15. A mechanism according to claim 1, wherein said dispensing outlet comprises a vertical passage.

16. A mechanism according to claim 1, wherein said dispensing outlet comprises a non-vertical passage.

17. A mechanism according to claim , wherein said dispensing outlet comprises a movable door to collect a batch of shaved ice prior to dispensing.

18. A mechanism according to claim 1, wherein said dispensing outlet comprises an auger to collect a batch of shaved ice prior to dispensing.

19. A mechanism according to claim 1, wherein said dispensing outlet comprises a paddle to collect a batch of shaved ice prior to dispensing.

20. A mechanism according to claim 1, wherein said dispensing zone comprises a single well in which ice cubes and shaved ice are dispensed to a user.

21. A mechanism according to claim 20, including a movable door to allow said ice cubes to selectively bypass said ice shaving mechanism.

22. A mechanism according to claim 20, wherein said single well includes a pusher and a plate having different openings therein for selective passage of ice cubes and shaved ice.

23. A mechanism according to claim 22, wherein said plate is rotatable.

24. A mechanism according to claim 22, including a cover positioned over said plate, said cover having an ice passage therethrough, and at least one of said cover and said plate being rotatable relative to the other.

25. A mechanism according to claim 1, wherein said dispensing zone comprises a dual path in which ice cubes and shaved ice are dispensed to a user via different paths through the dispensing zone.

26. A refrigeration appliance comprising:

a first refrigerated compartment arranged to be held at a temperature below room temperature and above the freezing point of water, a second refrigerated compartment arranged to be held at a temperature below the freezing point of water, an ice making mechanism in said second refrigerated compartment, an ice delivery system arranged to deliver ice from said ice making mechanism, an ice shaving mechanism located in said refrigeration appliance arranged to selectively shave ice received from said ice delivery system, a control mechanism arranged to allow a user to selectively activate said ice shaving mechanism; and an ice dispensing system arranged to dispense ice trough a door providing access to one of said first and second refrigerated compartments, wherein ice may be dispensed in a shaved condition or a non-shaved condition.

27. A refrigeration appliance according to claim 26, wherein said non-shaved condition comprises crushed ice.

28. A mechanism according to claim 26, wherein said ice shaving mechanism comprises a pusher rotatably driven by a motor for pushing ice and a fixed blade against which said ice is pushed by said rotating pusher.

29. A mechanism according to claim 26, wherein said ice shaving mechanism comprises a pusher and a blade, at least one of which is rotated relative to the other by a motor.

30. A mechanism according to claim 26 wherein said dispensing zone comprises a dual path in which ice cubes and shaved ice are dispensed to a user via different paths through the dispensing zone.

31. A refrigeration appliance comprising:

a refrigerated compartment, an ice making mechanism in said refrigerated compartment arranged to make cubed ice, an ice delivery system arranged to deliver cubed ice from said ice making mechanism, an ice crushing mechanism located in said refrigeration appliance arranged to selectively crush ice received from said ice delivery system, an ice shaving mechanism located in said refrigeration appliance arranged to selectively shave ice received from said ice delivery system, a control mechanism arranged to allow a user to selectively and alternately activate one of said ice shaving mechanism and said ice crushing mechanism; and an ice dispensing system arranged to dispense ice, wherein ice may be dispensed in a shaved condition, a crushed condition or a cubed condition.

32. A refrigeration appliance according to claim 31, wherein said ice is dispensed to a user through a door of said refrigeration appliance.

33. A refrigeration appliance according to claim 31, including a reservoir arranged to receive cubed ice from said ice making mechanism and wherein said ice shaving mechanism is located in said reservoir.

34. A refrigeration appliance according to claim 31, wherein said ice dispensing system includes a dispensing zone with an outlet and wherein said ice shaving mechanism is located in one of said dispensing zone and outlet.

35. A refrigeration appliance according to claim 31, wherein said dispensing system is further arranged to dispense liquid water from said refrigeration appliance.

36. A mechanism according to claim 31, wherein said ice shaving mechanism comprises a pusher rotatably driven by a motor for pushing ice and a fixed blade against which said ice is pushed by said rotating pusher.

37. A mechanism according to claim 31, wherein said ice shaving mechanism comprises a pusher and a blade, at least one of which is rotated relative to the other by a motor.

38. A mechanism according to claim 31, wherein said dispensing zone comprises a dual path well in which ice cubes and shaved ice are dispensed via different paths in the dispensing zone to a user.

* * * * *